US012492615B2

(12) United States Patent
Hern et al.

(10) Patent No.: US 12,492,615 B2
(45) Date of Patent: Dec. 9, 2025

(54) ENERGY HARVESTER, METHOD AND SYSTEM

(71) Applicant: Baker Hughes Oilfield Operations LLC, Houston, TX (US)

(72) Inventors: Christopher Hern, Porter, TX (US); Daniel Ewing, Katy, TX (US); Andrew Duggan, Meadows Place, TX (US); Ronnie Russell, Cypress, TX (US); Kamalesh Chatterjee, Tomball, TX (US); Scott P. Christopher, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/313,738

(22) Filed: May 8, 2023

(65) Prior Publication Data

US 2024/0376803 A1 Nov. 14, 2024

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
See application file for complete search history.

(56) References Cited

U.S. PATENT DOCUMENTS 9,074,437 B2 7/2015 Stingerie et al.
2002/0121377 A1* 9/2002 Longbottom ..... E21B 41/0085 166/66.4
2010/0052324 A1 3/2010 Priya
2011/0278990 A1 11/2011 Knowles et al.
2016/0164437 A1* 6/2016 Kim ..... H02N 2/185 310/339
2016/0276900 A1 9/2016 Gawski et al.
2019/0292883 A1 9/2019 Pei et al.

FOREIGN PATENT DOCUMENTS

EP 3430697 B1 7/2020

OTHER PUBLICATIONS

Lee, et al.; "Piezoelectric Energy Harvesting in Internal Fluid Flow"; Sensors 2015, 15, 26039-26062; doi: 10.3390/s151026039; www.mdpi.com/journal/sensors; 25 pages.
Notification of Transmittal of the International Search Report and Written Opinion; PCT/US2024/027132; Korean Intellectual Property Office; Mailed Aug. 20, 2024; 10 pages.

* cited by examiner

*Primary Examiner* — Joseph Ortega
(74) *Attorney, Agent, or Firm* — Baker Hughes Patent Organization

(57) ABSTRACT

An energy harvester, including a housing, an impeller supported in the housing, an agitator operably connected to the impeller, and a piezoelectric member supported by the housing, the member deflectable by the agitator due to rotation of the impeller. A method of generating power from a flowing fluid, including rotating an impeller with the flowing fluid, actuating an agitator with the impeller, and deflecting a piezoelectric member with the agitator. A borehole system, including a borehole in a subsurface formation, a string in the borehole, and an energy harvester disposed within or as a part of the string.

22 Claims, 27 Drawing Sheets

ENERGY HARVESTER, METHOD AND SYSTEM

BACKGROUND

In the resource recovery and fluid sequestration industries, power is needed for many different operations. Power may be supplied from surface, from batteries, or may be generated on site using various generator type devices. Most generators have a relatively significant impact on flow in the borehole. The art would welcome alternative devices that harvest energy without significantly impacting flow characteristics or other well operations.

SUMMARY

An embodiment of an energy harvester, including a housing, an impeller supported in the housing, an agitator operably connected to the impeller, and a piezoelectric member supported by the housing, the member deflectable by the agitator due to rotation of the impeller.

An embodiment of a method of generating power from a flowing fluid, including rotating an impeller with the flowing fluid, actuating an agitator with the impeller, and deflecting a piezoelectric member with the agitator.

An embodiment of a borehole system, including a borehole in a subsurface formation, a string in the borehole, and an energy harvester disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
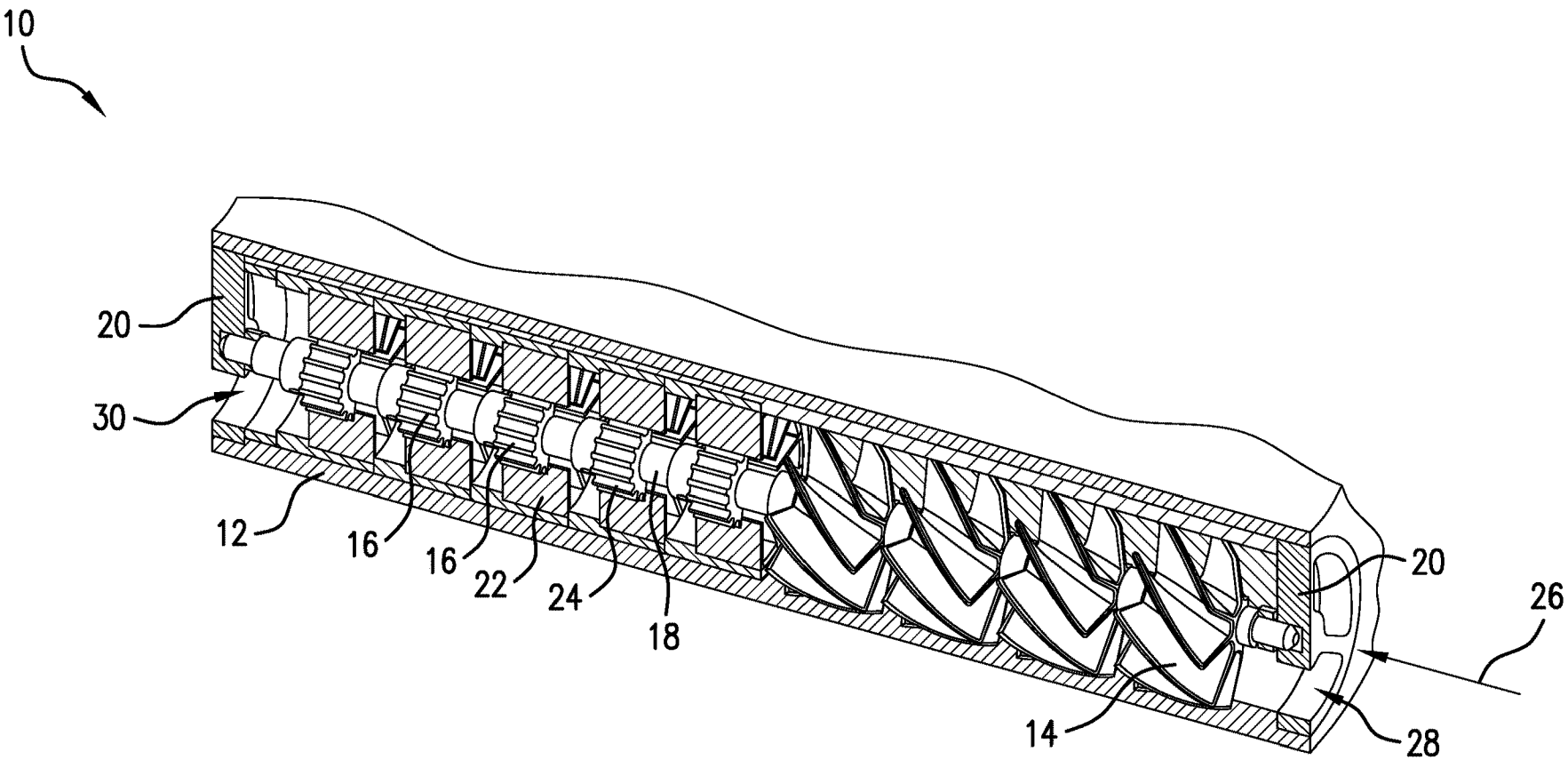
FIG. 1 is a partial sectional perspective view of an energy harvester disclosed herein.
Figure 2:
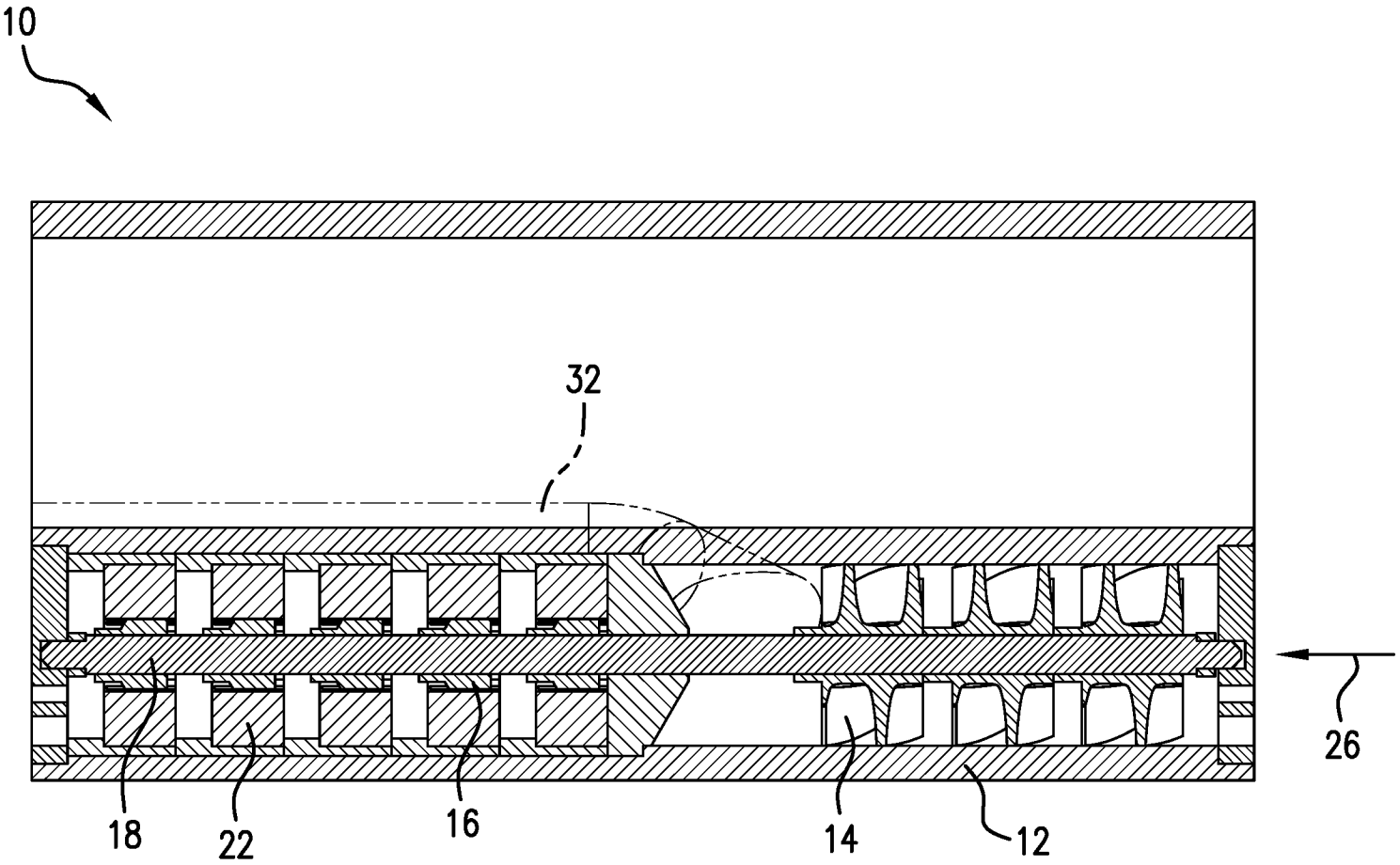
FIG. 2 is a sectional view of the same type of harvester as FIG. 1 but with a fluid bypass in the housing.
Figure 3:
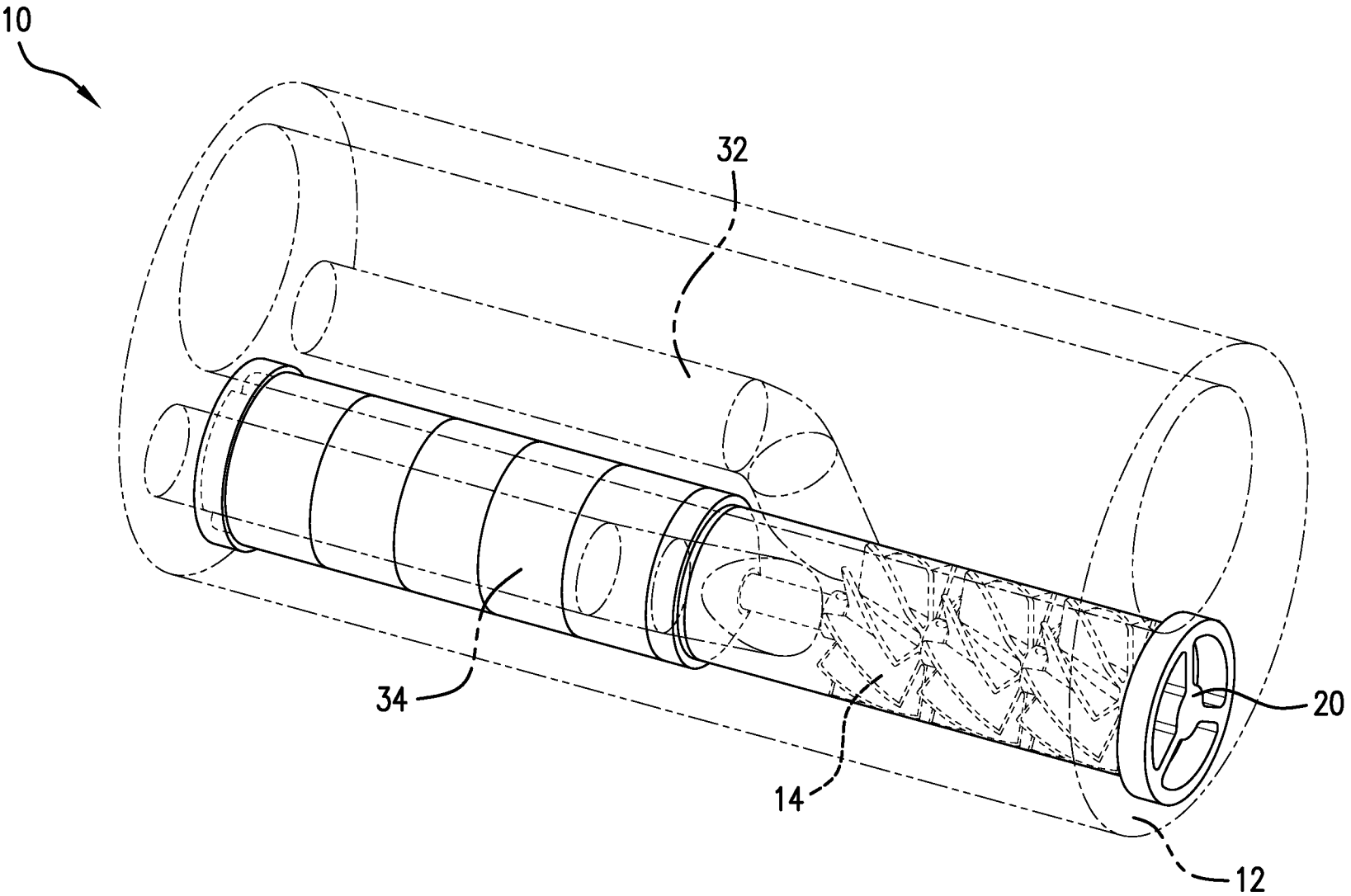
FIG. 3 is a sectional view of the same type of harvester as FIG. 1 but with a plurality of fluid bypasses.

Referring to FIGS. 1 and 2, an embodiment of an energy harvester 10 is illustrated. This embodiment includes a housing 12, supporting an impeller 14, that may be a plurality of impellers 14 as illustrated. Further, an agitator 16, or plurality thereof, are configured to be driven by the impeller 14. This may be by a shaft 18 upon which the impeller 14 and the agitator 16 are disposed. In such a case, the shaft 18 is supported by the housing 12 or supports 20 disposed in the housing 12. Upon flow of fluid through the housing 12 and over the impeller 14, the impeller 14 rotates, causing the shaft 18 to rotate and hence causing the agitator 16 to rotate. Upon rotation of the agitator 16, a piezoelectric member 22 is deflected and then released. This motion causes the member 22 to generate an electrical potential. There may be a plurality of members 22 located about and/or along the housing 12 each of which will be deflected and then released compounding the potential created such that usable energy may be harvested. In this embodiment the members 22 are mounted at a radially outward edge of each member 22 to the housing 12 or an intermediate mounting sleeve 36 and they extend radially inwardly toward the agitator 16. Contact is made between a protrusion 24 (such as a tooth or teeth) of the agitators 16 (which may be formed, for example, by milling slots or splines at the outside surface of the agitator 16, attaching material to the outside surface by welding, gluing, mechanically fastening, etc.) to cause the noted deflection during rotation of the agitator 16. The number of teeth and spacing of teeth may be selected to create differing deflection and release patterns (see FIGS. 15A-14E for visuals of some of the possible iterations). FIG. 15A-E provides a visual understanding of how the different configurations of agitator can have different effects on energy production from the harvester. The embodiment of FIG. 15A engages only one member 22 at a time and accordingly reduces resistance. FIG. 15B also reduces resistance by managing the phase of member engagement avoiding more than one tooth at the same phase of engagement with members 22 at the same time. FIG. 15C increase the resistance because a plurality of members 22 are engaged at the same time and in the same phase but output is correspondingly increased. FIG. 15D configures teeth 24 to engage all members 22 at the same time, thereby maximizing output but also experiencing the largest resistance. FIG. 15E illustrates a combination of some of the foregoing in that all of the members 22 are engaged at the same time but the phases of engagement are different. This embodiment will reduce resistance in comparison to the embodiment of FIG. 15D and will smooth the output to be near continuous energy production. In the FIG. 1 illustration fluid flows in one direction arrow 26 or the other from one end 28 to the other 30 (or vice versa), that flow being through the members 22. In an alternate embodiment, see FIG. 2, the fluid flow direction is the same, see arrow 26, but the fluid flow it diverted around the members 22 through a bypass channel 32. FIG. 3 illustrates an additional bypass channel 34.

Figure 4:
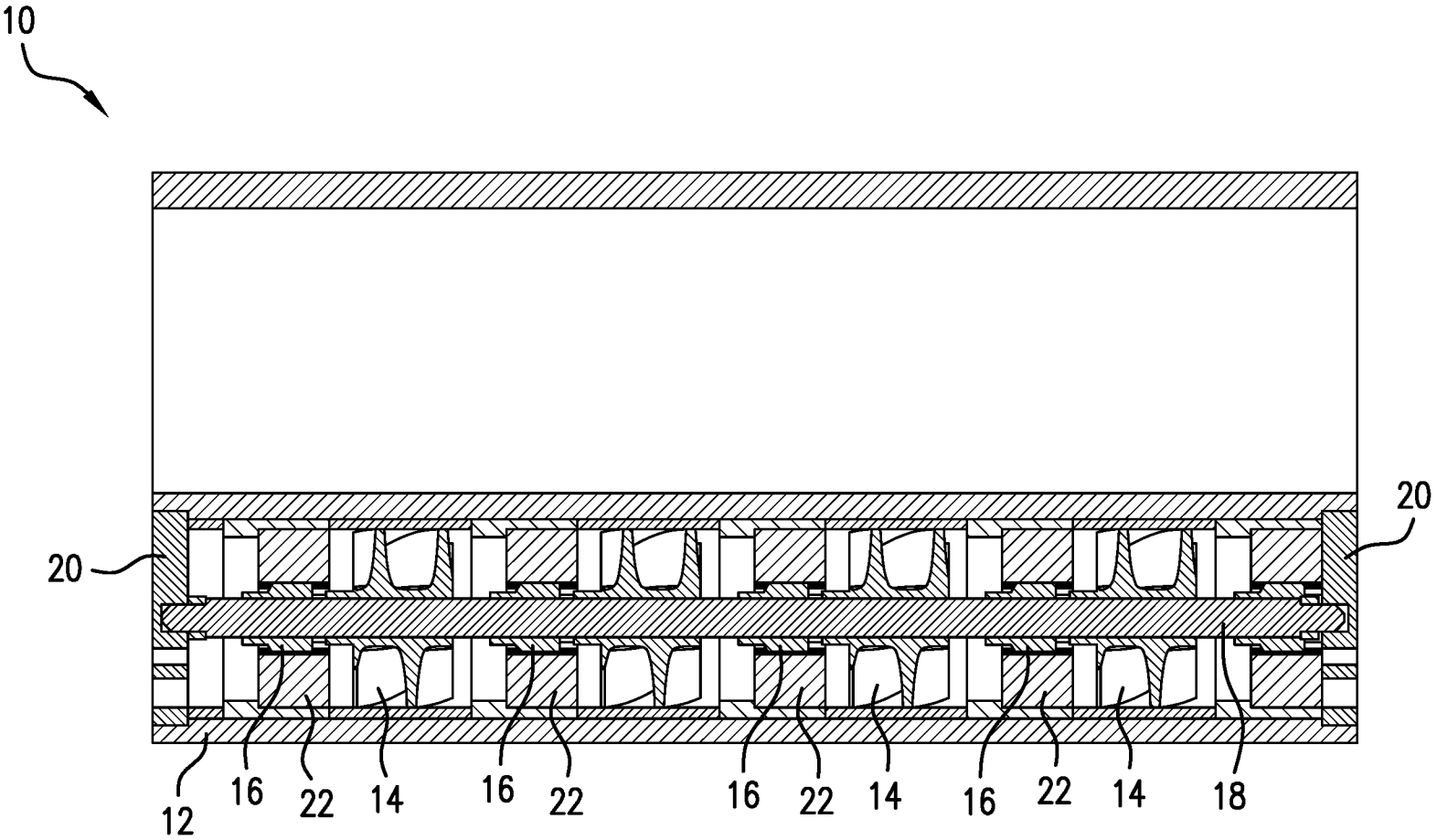
FIG. 4 is a sectional view similar to FIG. 1 but with impellers located between piezoelectric members.

Referring to FIG. 4, another embodiment is illustrated wherein a plurality of impellers 14 are disposed adjacent individual groups of members 22. This embodiment requires that the members 22 are in the fluid flow as diverting the flow would cause that flow to miss the impellers 14 and hence result in reduced torque applied to the shaft 18 and agitators 16. This embodiment also has a flow straightening effect due to the members 22 being located between impellers 14, which helps to force the flow to a more axial (longitudinal) direction rather than a helical pattern of fluid flow that would result in fluid passing by the impellers without the interposed members 22 Further, this embodiment includes the possibility that the impeller 14 and the agitator 16 may be either 1) separate but operably connected components or 2) a single collective component.

Figure 5:
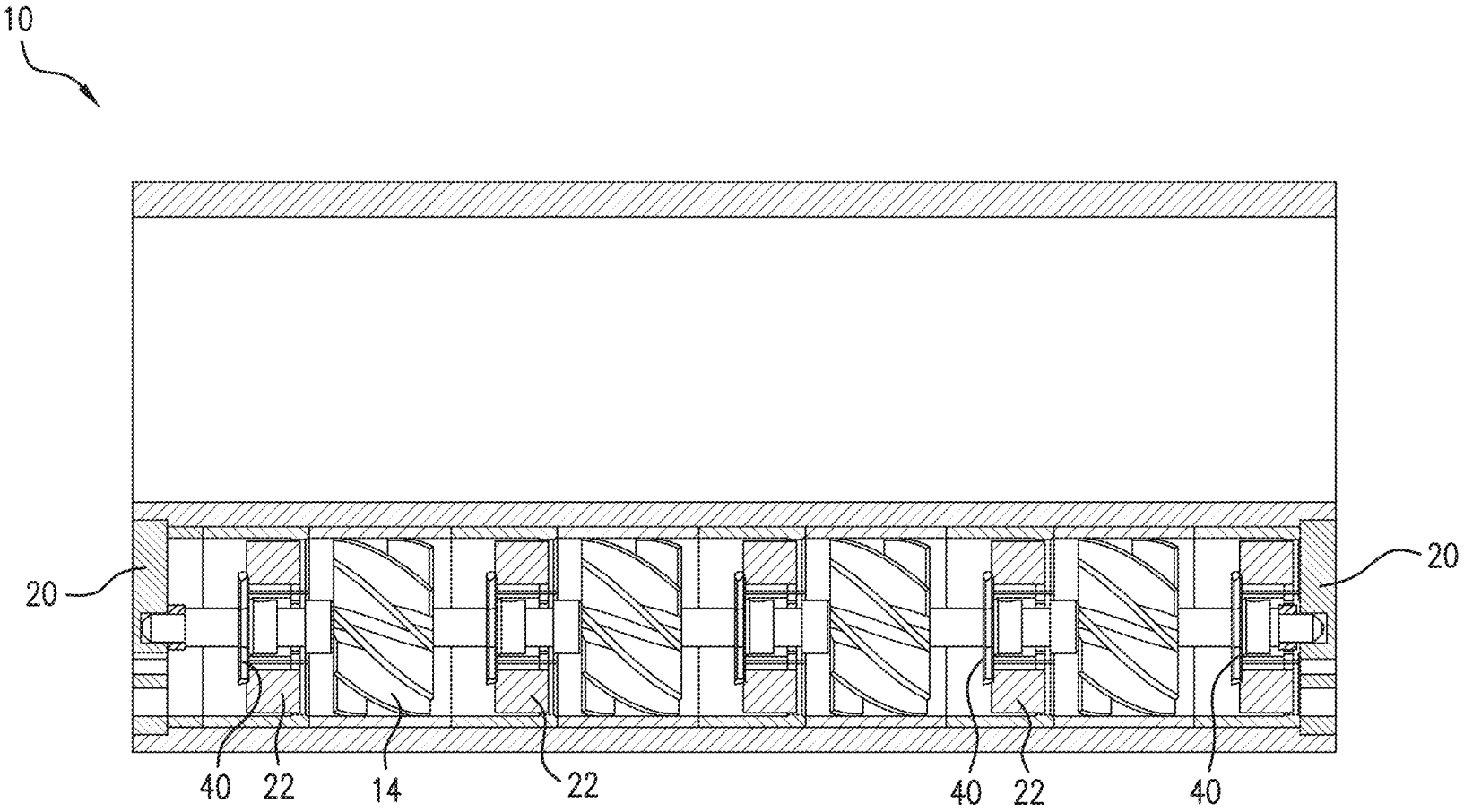
FIG. 5 is similar to FIG. 4 but has an alternate agitator arrangement.
Figure 6:
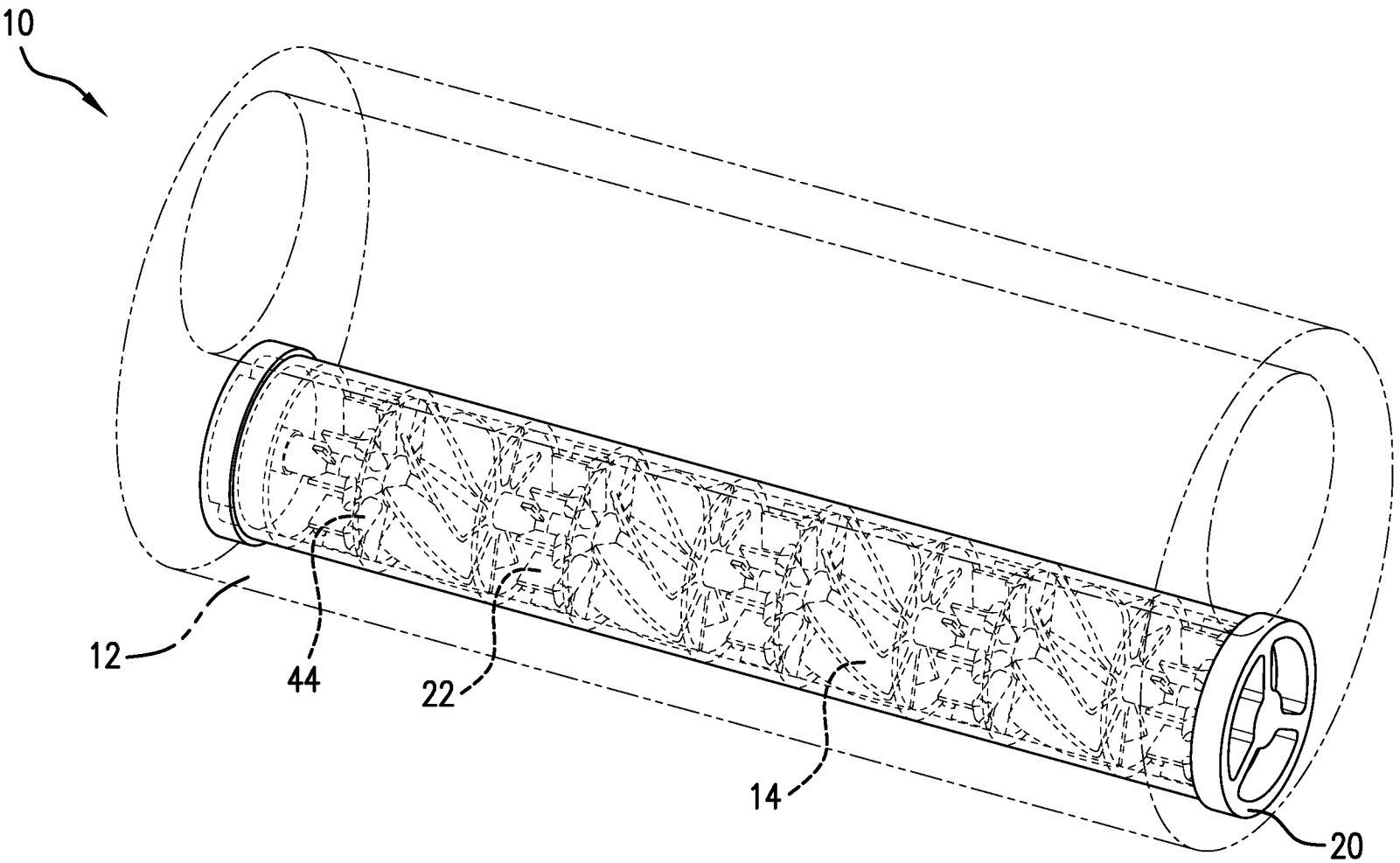
FIGS. 6 and 7 illustrate another embodiment similar to FIG. 5 but with an alternate piezoelectric member mounting.
Figure 7:
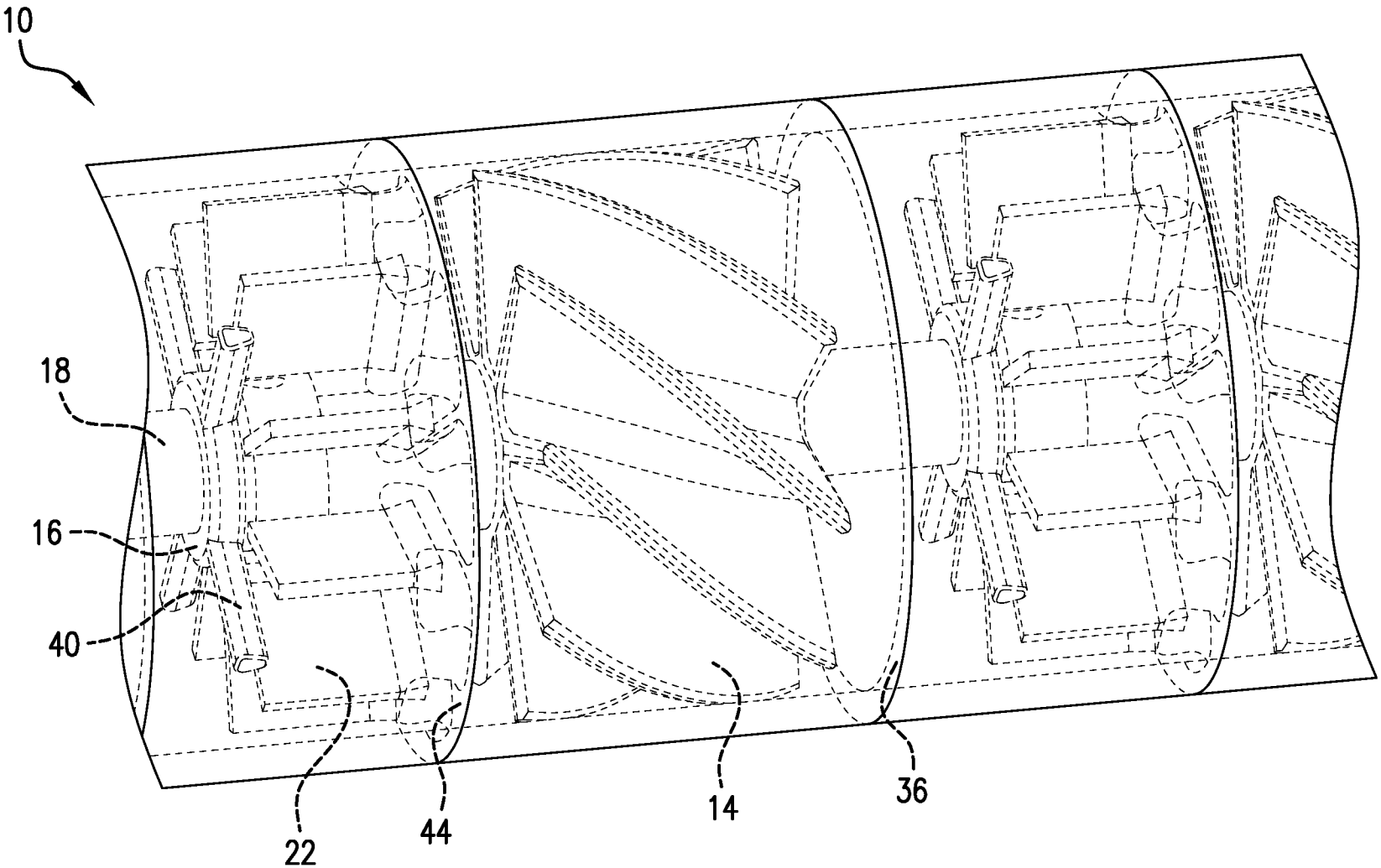

Referring to FIGS. 5, 6 and 7, yet another embodiment is illustrated. In the embodiment of FIG. 6, the members 22 are not mounted at their radially outward edges like that of FIG. 1, but rather are mounted at one longitudinally oriented edge 42 by support 44. Support 44 is in one iteration a disk-shaped member that is orthogonally oriented relative to the housing 12 and is affixed to the housing directly or indirectly so that the support 44 is up to the task of holding the members 22. Upon rotation of the impellers 14, shaft 18, and agitator 16, the arms 40 contact and deflect the members 22, bending the members 22 longitudinally and releasing them to recover their original position.

Figure 8:
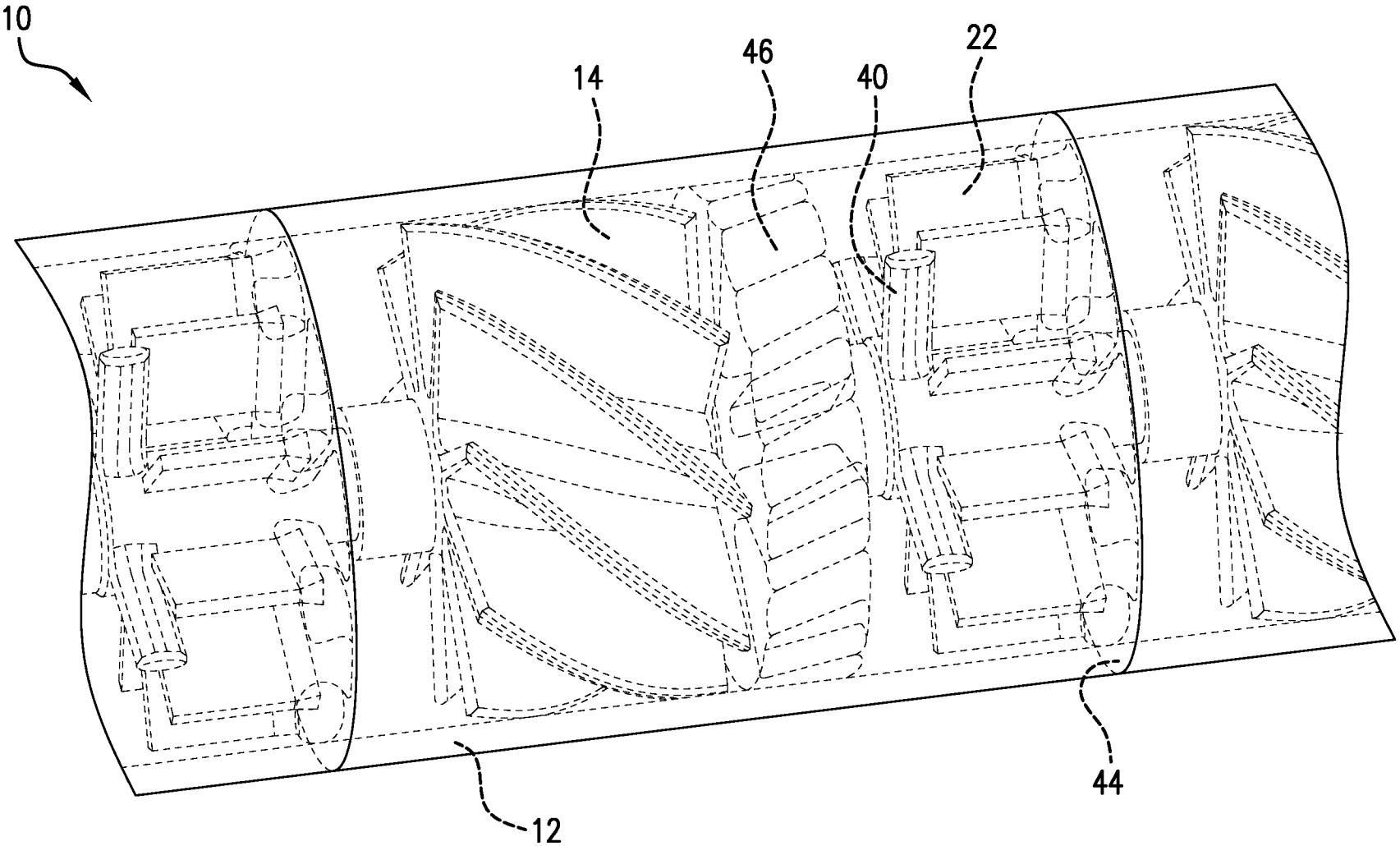
FIG. 8 is a partially transparent perspective view of another embodiment that employs flow straighteners adjacent each impeller and an integrated impeller and agitator.

Referring to FIG. 8, another embodiment is illustrated. Distinct in this embodiment is the introduction of straighteners 46 that fiction to straighten the fluid flow that is incident an impeller 14. Straighteners are fixedly mounted in the housing 12 and do not rotate. Rather they simply interfere with incoming flow and cause it to move longitudinally of the housing 12. This can be beneficial where multiple impellers are used between members 22. Straightening the flow will help ensure maximum energy input to the impeller from the fluid flow. The particularly illustrated embodiment of FIG. 8 is very similar to that of FIG. 7 but it is to be understood that the straighteners 46 may be employed with any of the embodiments hereof for the same purpose. As illustrated, it should be understood that the impeller 14 and agitator 16 of the embodiment may be separate or may comprise a single unit.

Referring now to FIGS. 9-13, another set of embodiments is illustrated. These embodiments use an impeller drive 54 where the impeller vanes 56 are disposed on the inside of a drive housing 58. The drive housing 58 also functions as an agitator 60 with protrusions 62 on an outside diameter surface 64 of the housing 58. Protrusions 62 may be helical (FIGS. 10-12) producing a helically configured agitator or axially oriented (FIG. 13) and members 22 may be mounted in member housings 68 as illustrated. While the illustrations at FIGS. 15A-15E have dimensions that suggest utility with the other embodiments hereof, it is note that the protrusions of the embodiments of FIGS. 9-13 may be spaced in the same manner as the FIGS. 15A-15E with similar result.

Figure 9:
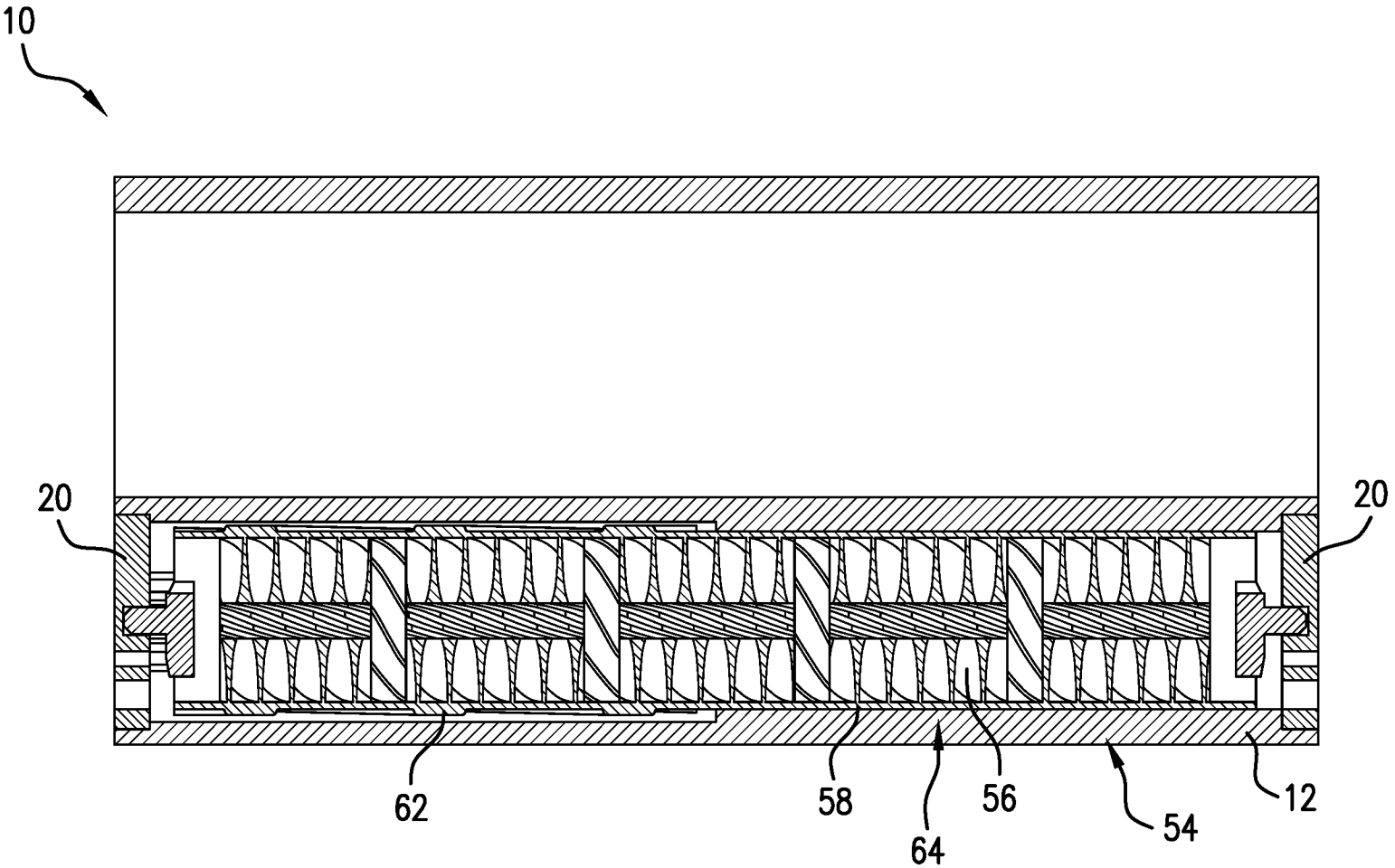
FIG. 9 is a sectional view to illustrate an alternate impeller that is used for FIGS. 10-13.
Figure 10:
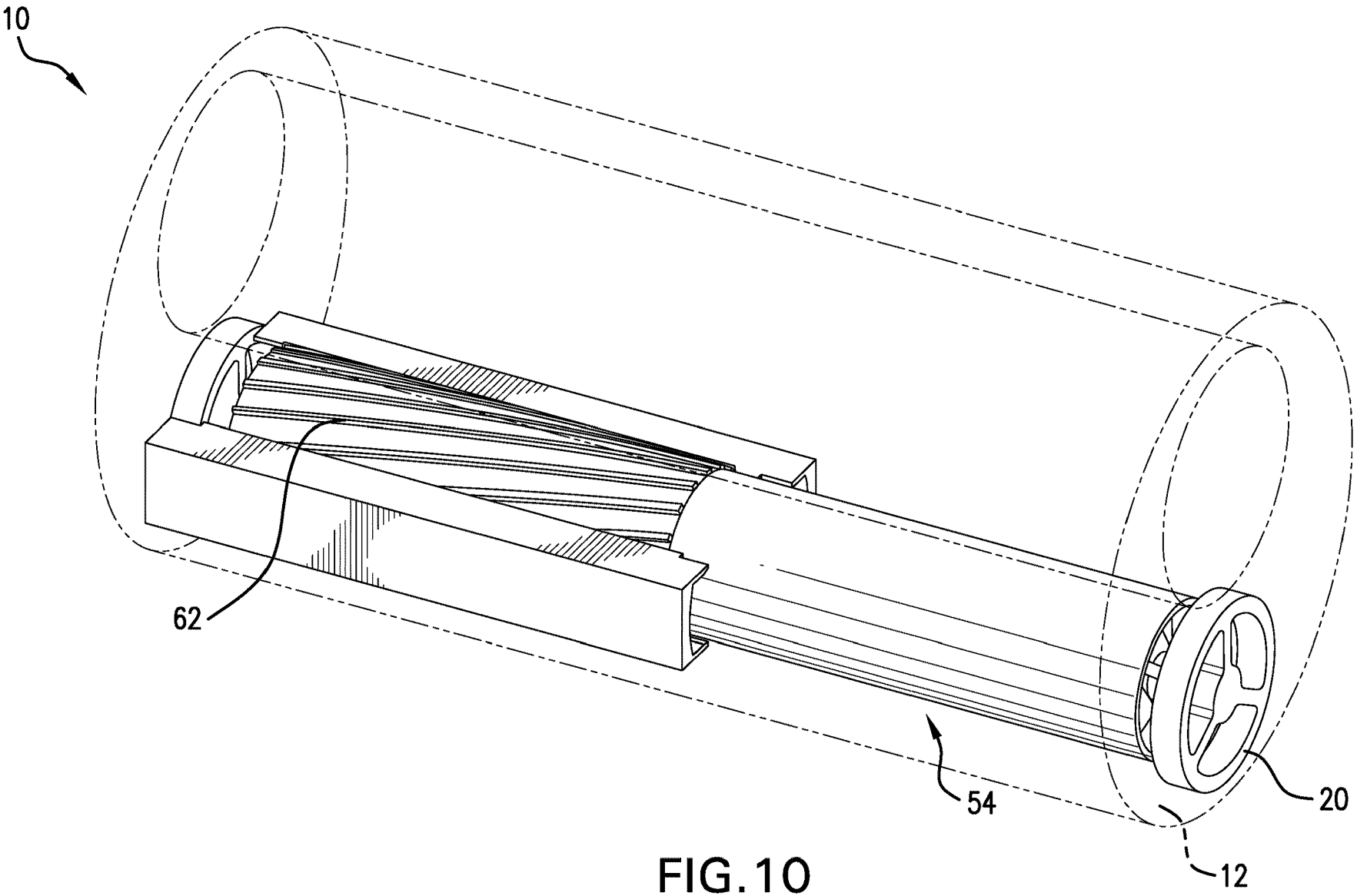
FIGS. 10, 11, and 12 are illustrative of an embodiment where the agitator includes helical protrusions.
Figure 11:
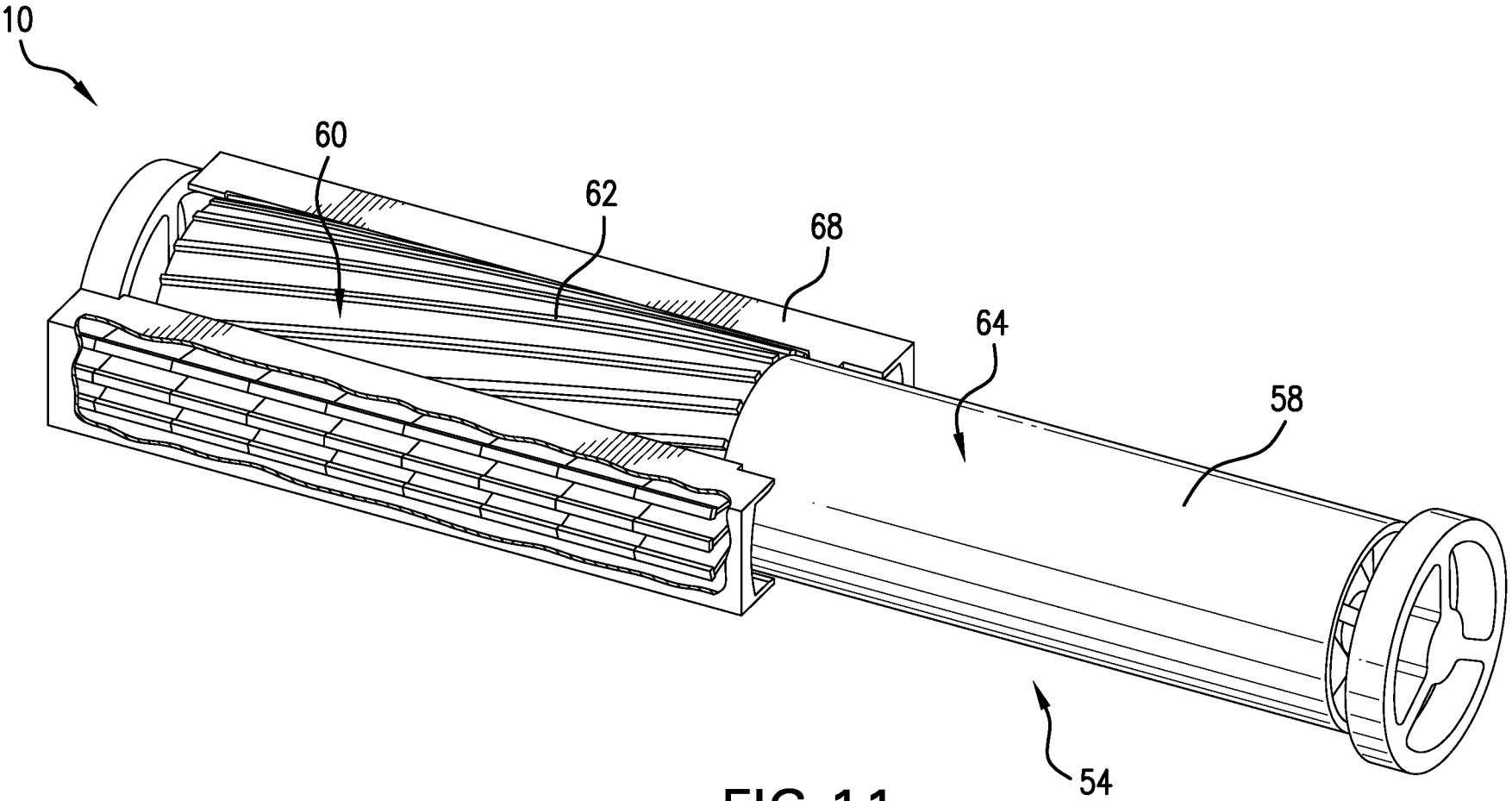
Figure 12:
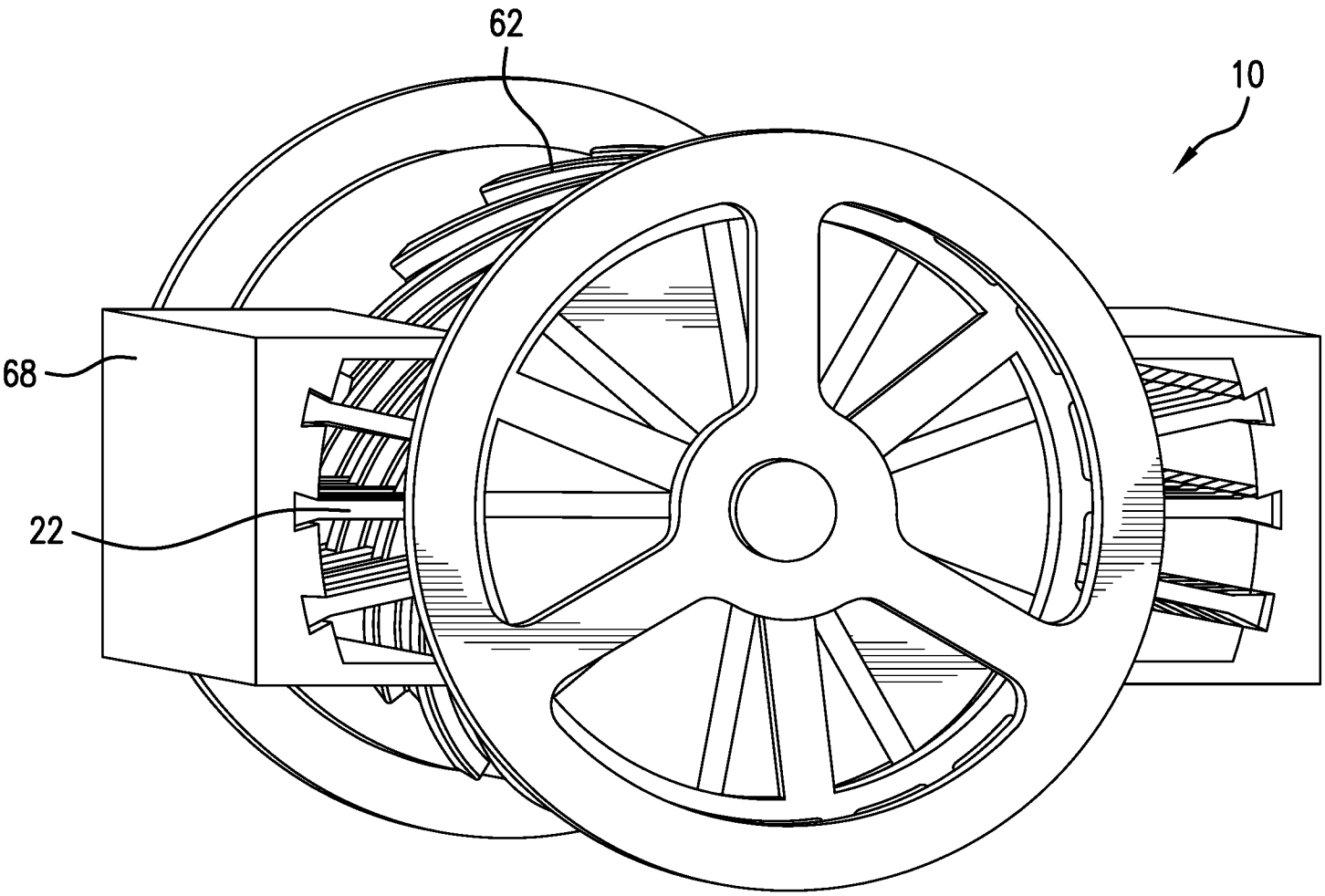
Figure 13:
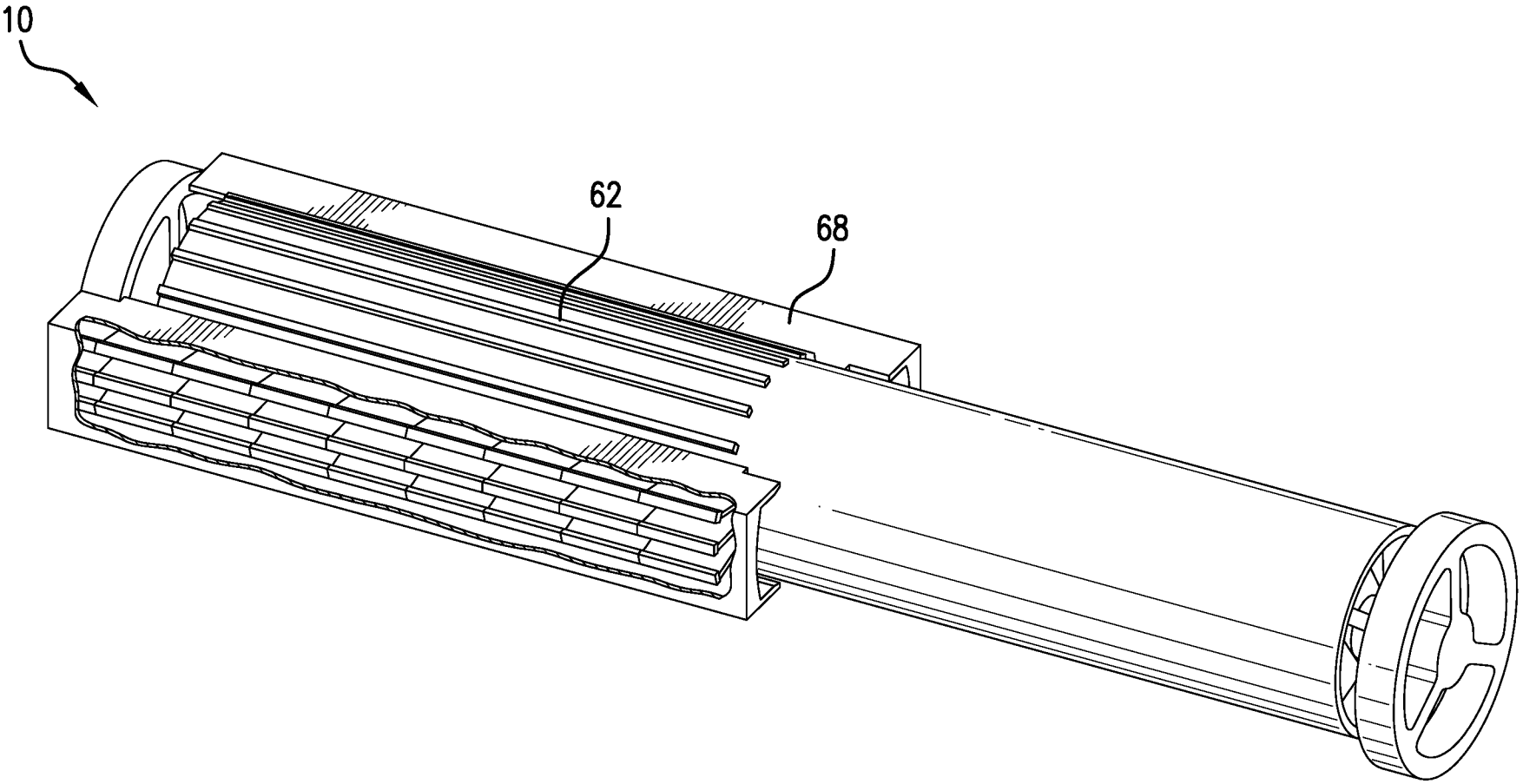
FIG. 13 illustrates an agitator similar to that of FIGS. 10-12 but with longitudinally oriented protrusions instead of helical protrusions.
Figure 14:
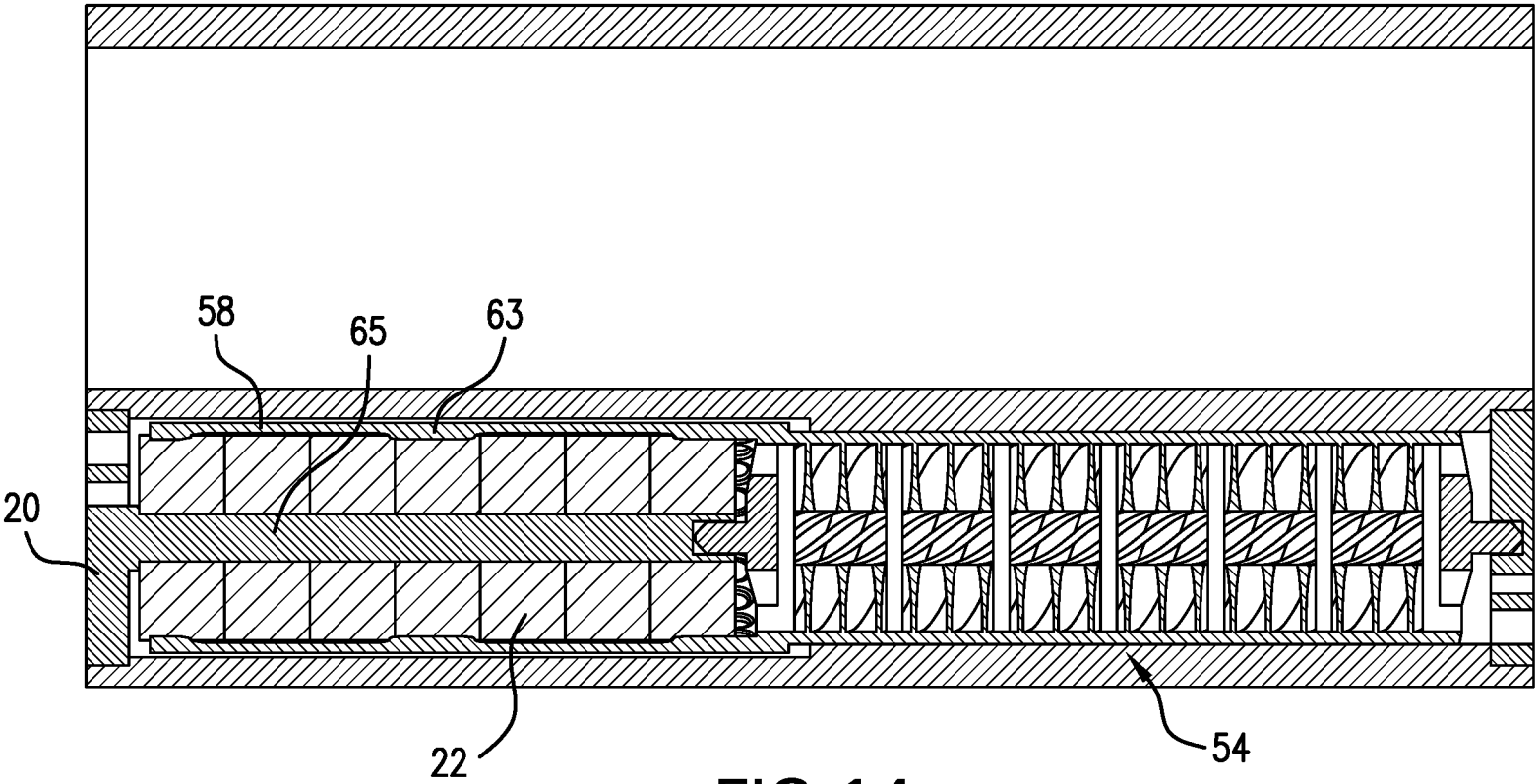
FIG. 14 is another agitator embodiment using the alternate impeller of FIG. 9.
Figure 15A:
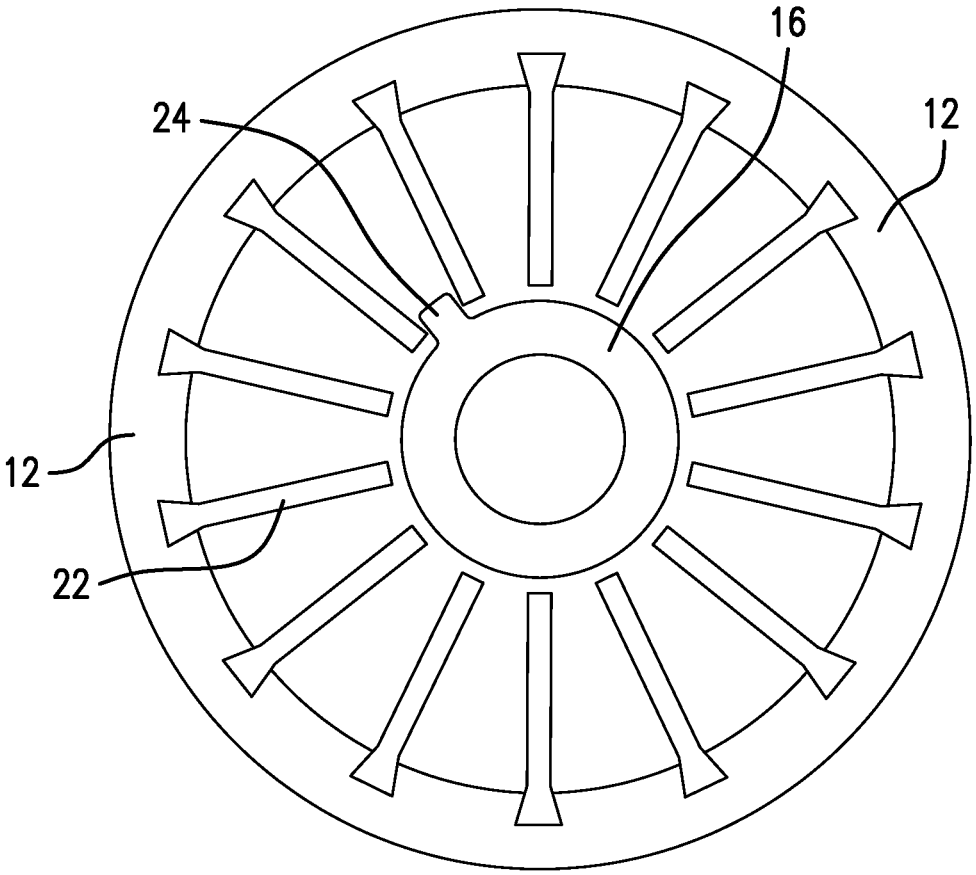
FIGS. 15A-15E illustrated various agitator tooth or protrusion configurations relative to the number of piezoelectric members.
Figure 15B:
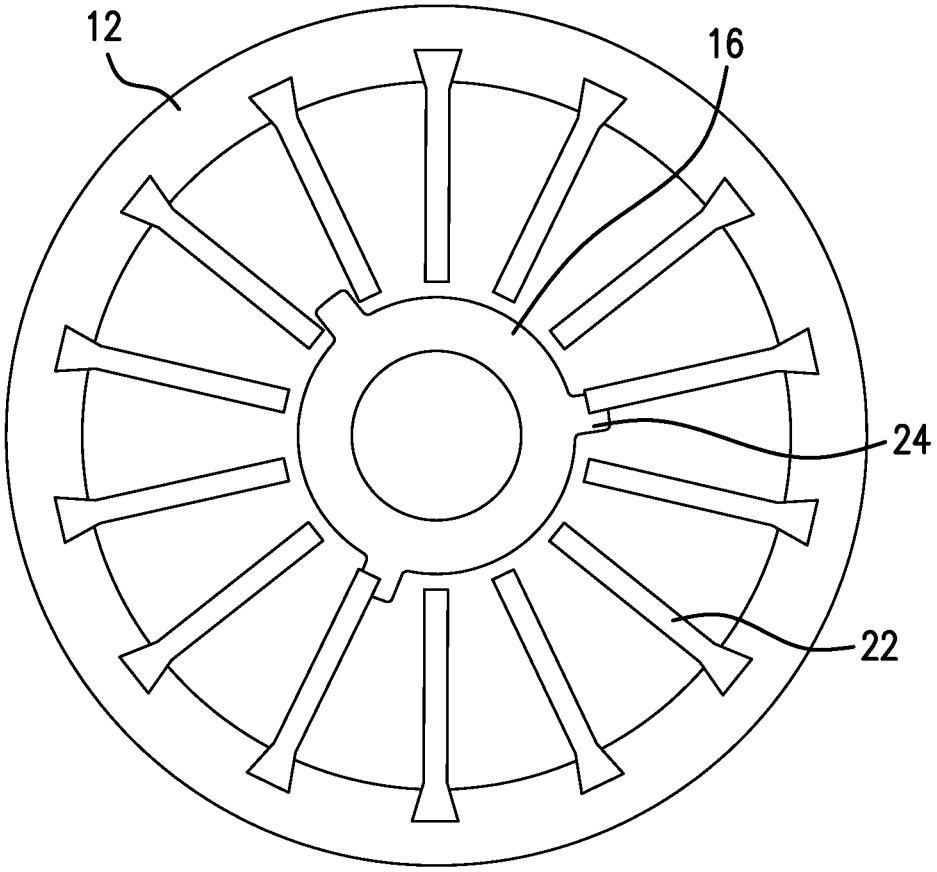
Figure 15C:
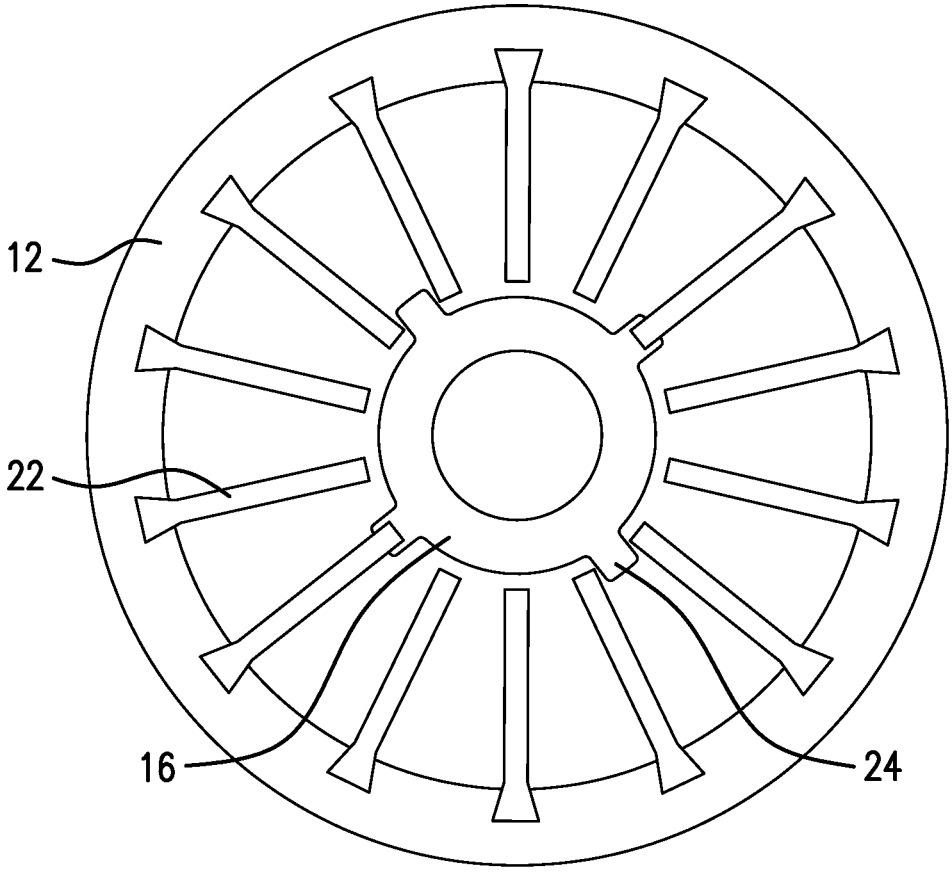
Figure 15D:
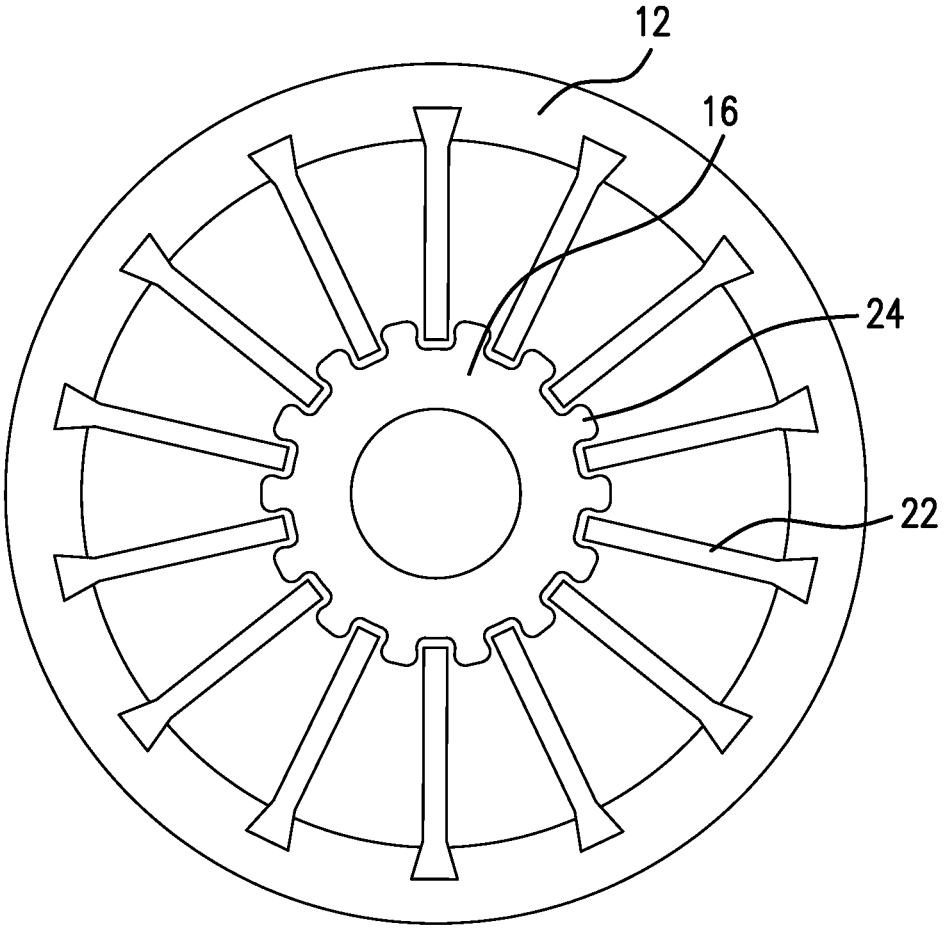
Figure 15E:
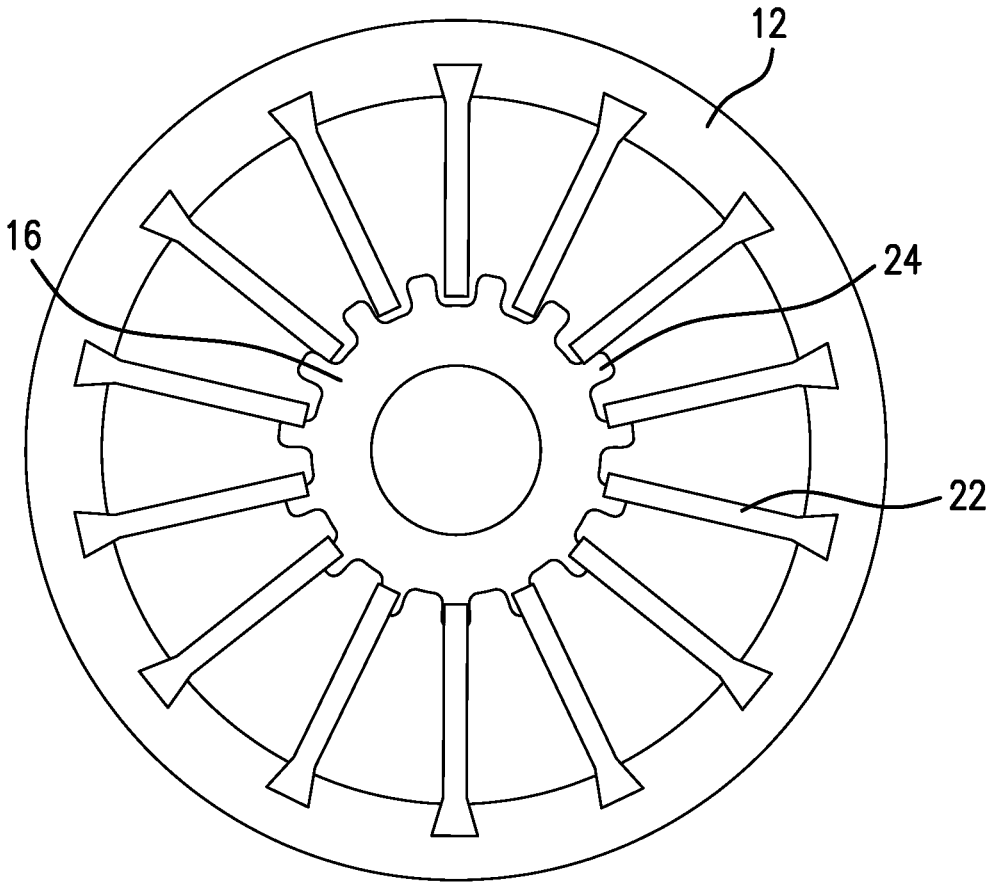

In another embodiment, referring to FIG. 14, the impeller drive 54 of FIG. 9 is employed but is modified in that the protrusions 62 from FIG. 9 are omitted in favor of protrusions 63 that extend radially inwardly from the housing 58 rather than radially outwardly as in FIGS. 9-13. In the case of FIG. 14, the inwardly directed projections 63 are configured to interact with members 22 that are mounted on a fixed arm 65 extending from support 20. Rotation of the housing 58 causes the protrusions 63 to move past the members 22 thereby deflecting and releasing them similar to the foregoing embodiments. Protrusions 63 may be helically arranged or axially arranged as shown in the other embodiments hereof. While the illustrations at FIGS. 15A-15E have dimensions that suggest utility with the other embodiments hereof, it is note that the protrusions of the embodiments of FIG. 14 may be spaced in the same manner as the FIGS. 15A-15E with similar result.

Figure 16:
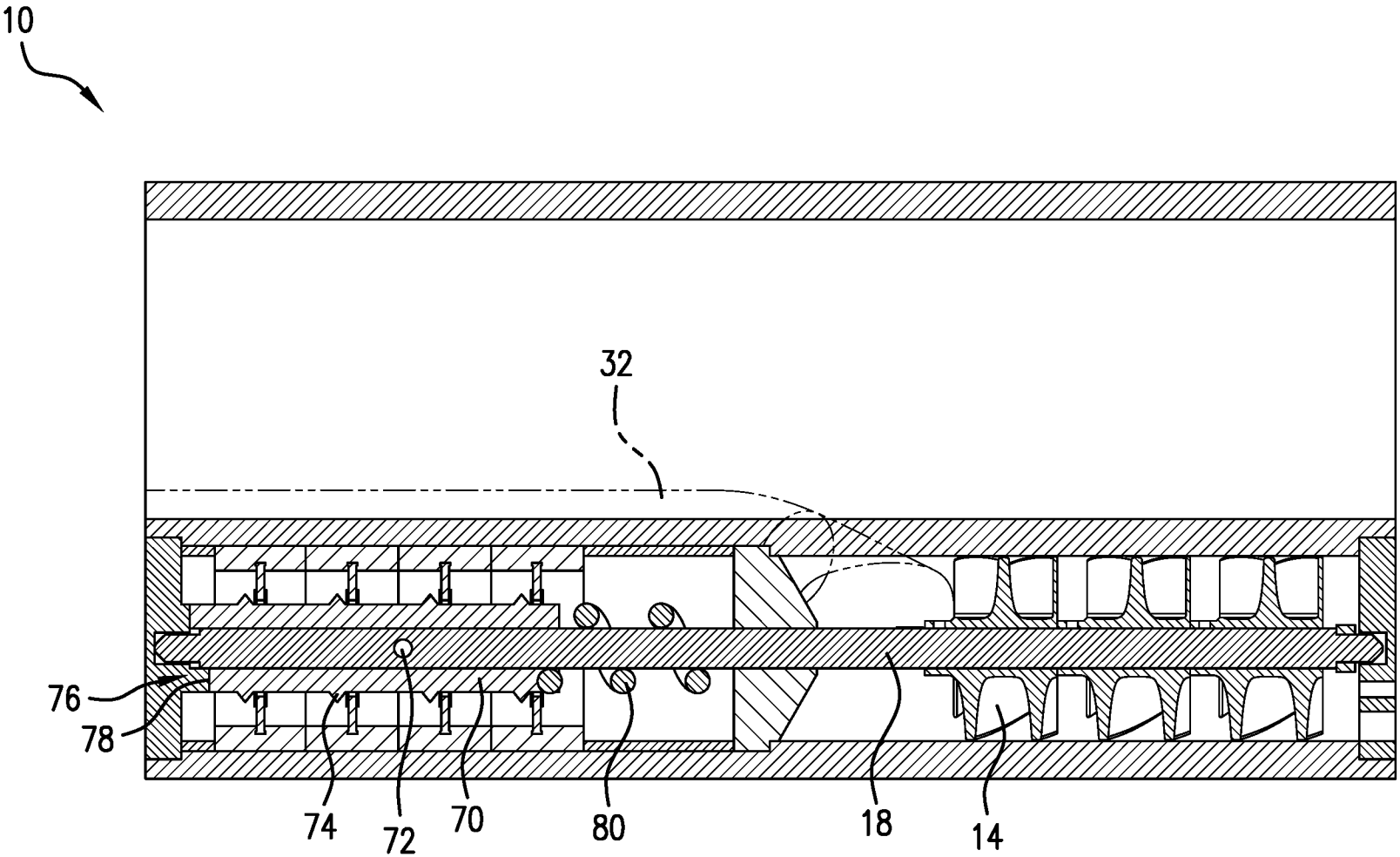
FIGS. 16 and 17 are a sectional view and perspective view, respectively of another embodiment of harvester.
Figure 17:
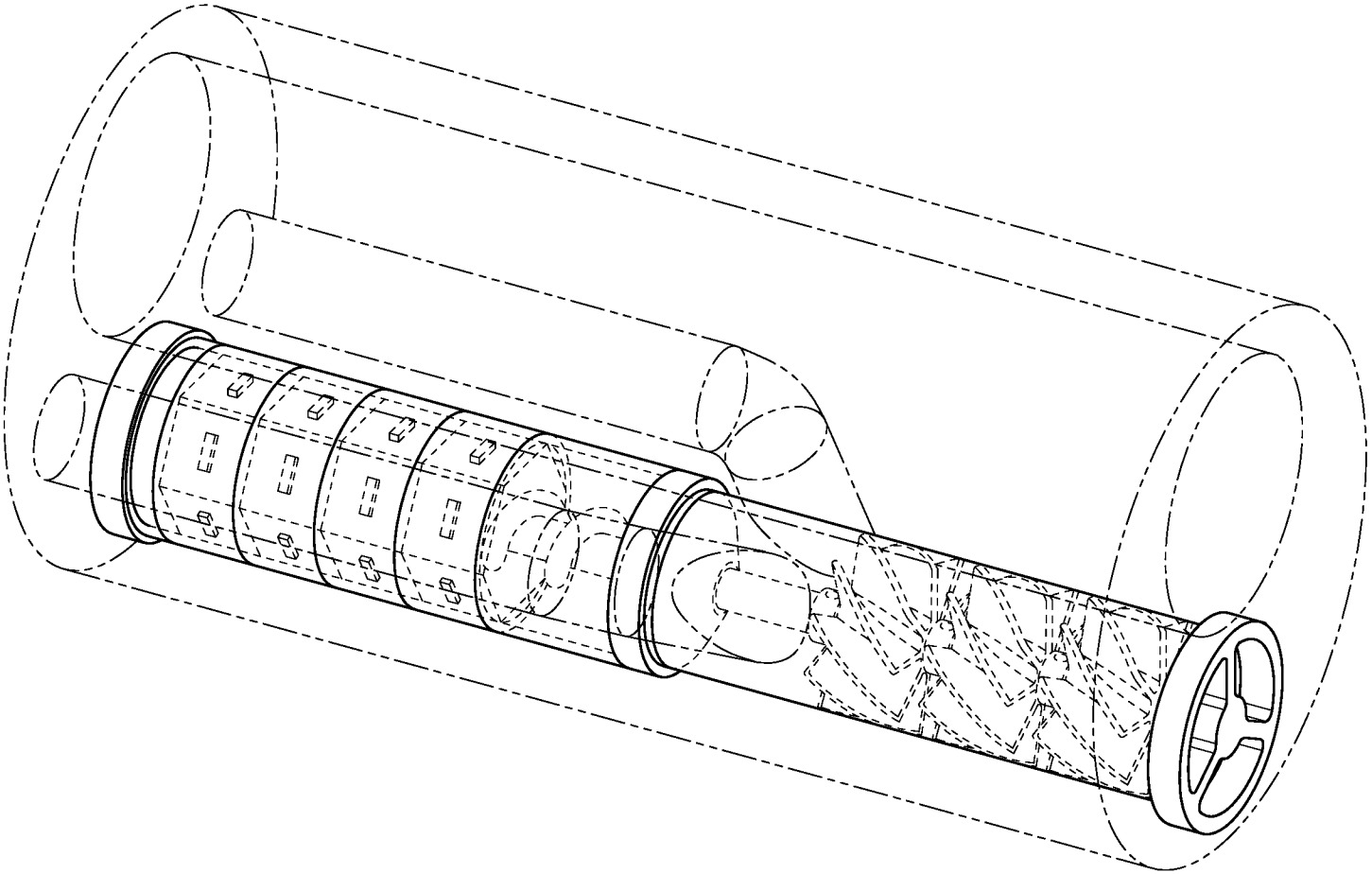

Referring now to FIGS. 16 and 17, another alternate embodiment of harvester 10 is illustrated. In this embodiment, impellers 14 similar to FIG. 1 are employed to cause rotation of the shaft 18. Torque from the shaft 18 is imparted to a sleeve 70 through a transfer pin 72. Sleeve 70 includes circumferential protrusions 74 thereon. Further sleeve 70 has an end 76 with a step helix 78. What is meant by "step helix" is a single rotation of a helical structure that is then joined longitudinally with a surface such that a follower starting on that helical surface at a low energy point will move along the helical surface to a higher energy point and then drop back to the lower energy point of the helix. This is also known as a cycloidal barrel cam. Energy for this operation could be gravity or any type of compressible media (Biaser) that will be compressed during the time the follower climbs the helix and then uncompresses when the follower drops back to the low energy point. Moving to FIG. 16, the energy comes from spring 80 since the spring will be compressed when the follower is at the highest part of the helix and then uncompress when the follower drops back to the low point. Because the pin causes the sleeve 70 to rotate with the shaft, the sleeve 70 will have movement back and forth that will cause the rings 74 to deflect and then release the members 22 twice for each revolution of sleeve 70. The embodiment includes a bypass 32 like in FIG. 2, since flow through the members 22 in this embodiment would create a significant pressure drop.

Figure 18A:
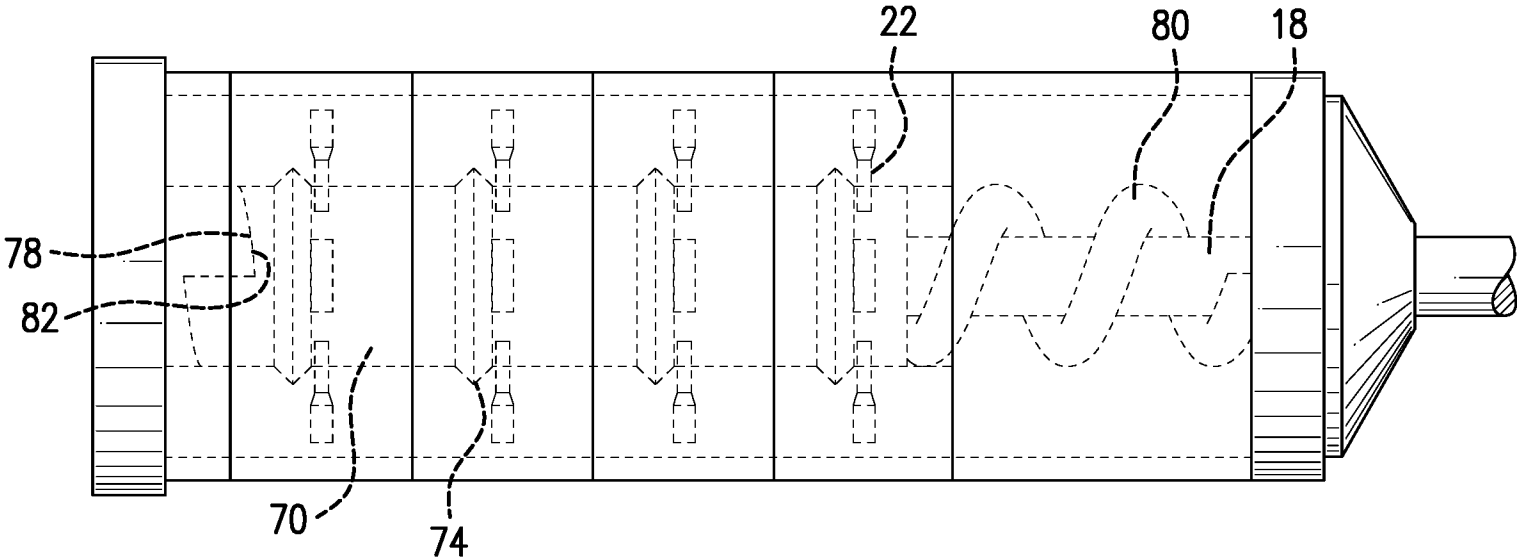
FIGS. 18A-18D illustrate positions of the embodiment of FIGS. 15 and 16.
Figure 18B:
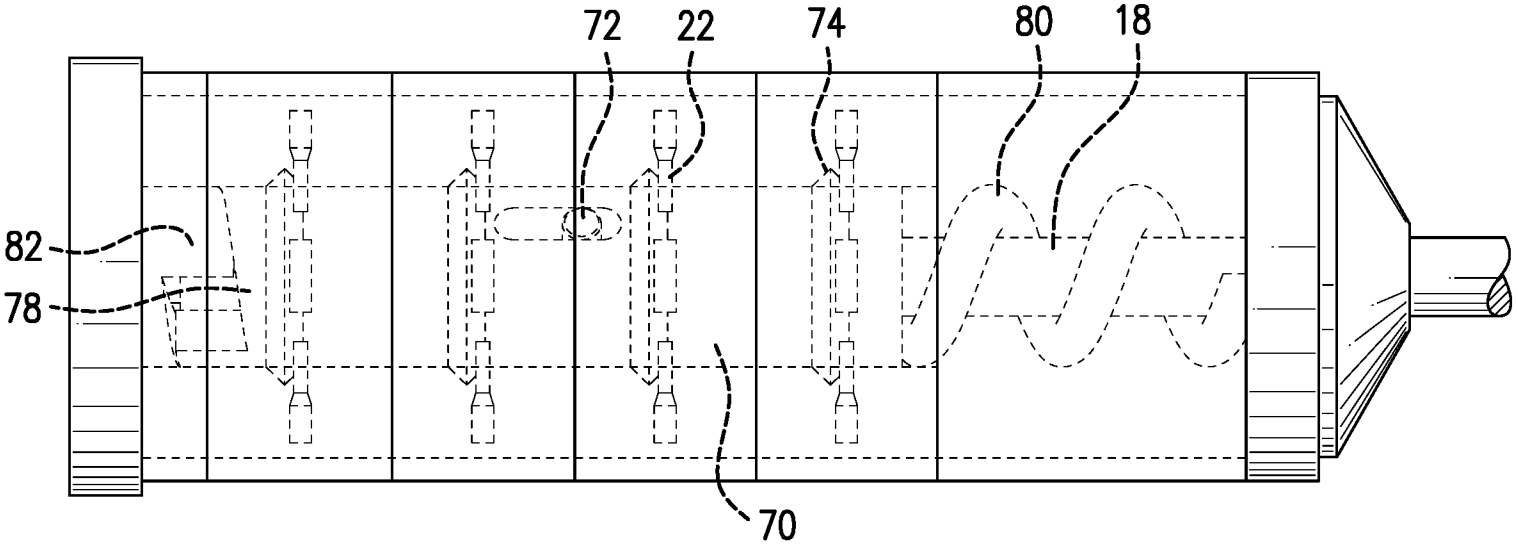
Figure 18C:
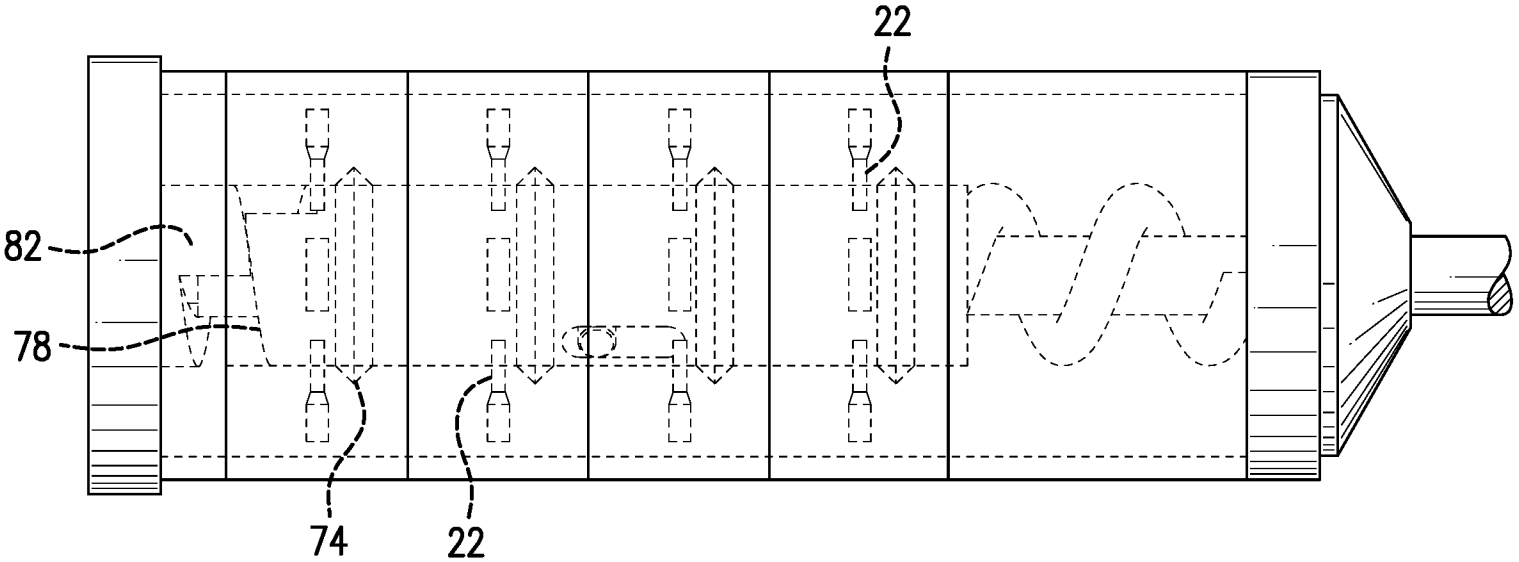
Figure 18D:
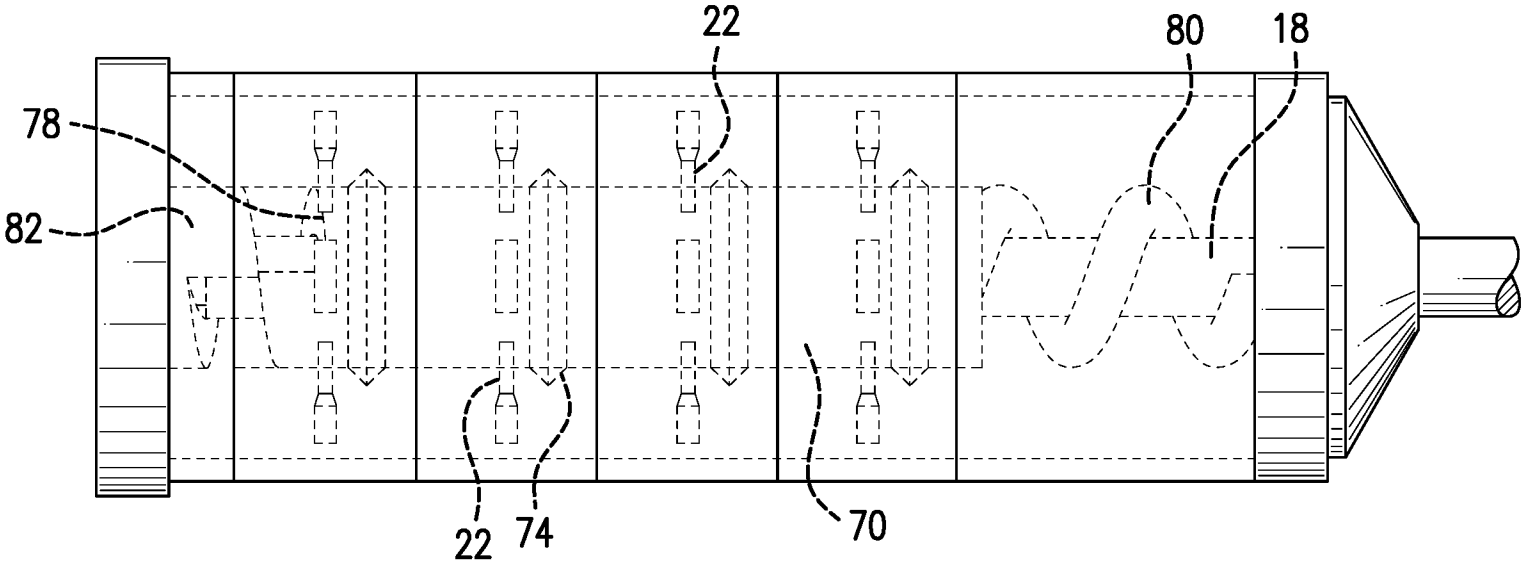

For a better understanding of the operation of the embodiment of FIGS. 16 and 17, reference is made to FIGS. 18A-18D, which illustrate sequential positions of the sleeve 70 during rotation. In FIG. 18A, the step helix 78 is fully nested with a follower 82. The follower 82 is nonrotational. When the shaft 18 caused sleeve 70 to rotate, the sequence of 18A, 18B, 18C, 18D occurs. It will be readily apparent by viewing these figures what is occurring. A slight additional rotation from the position illustrated in FIG. 18D will reset the device back to the position of FIG. 18A. As the sleeve 70 is thus moved by the follower 82 interaction with the step helix 78, the spring 80 is compressed. Accordingly, it is the spring 80 that moves the sleeve 70 back to the position illustrated in FIG. 18A when that motion is permitted by follower 82. It should also be appreciated that the rings 74 can be seen to the left of the members 22 in FIGS. 18A and 18B but to the right of the members 22 in FIGS. 18C and 18D. By moving the rings 74 in this way, the members 22 are deflected and released twice per full rotation of sleeve 70.

Figure 19:
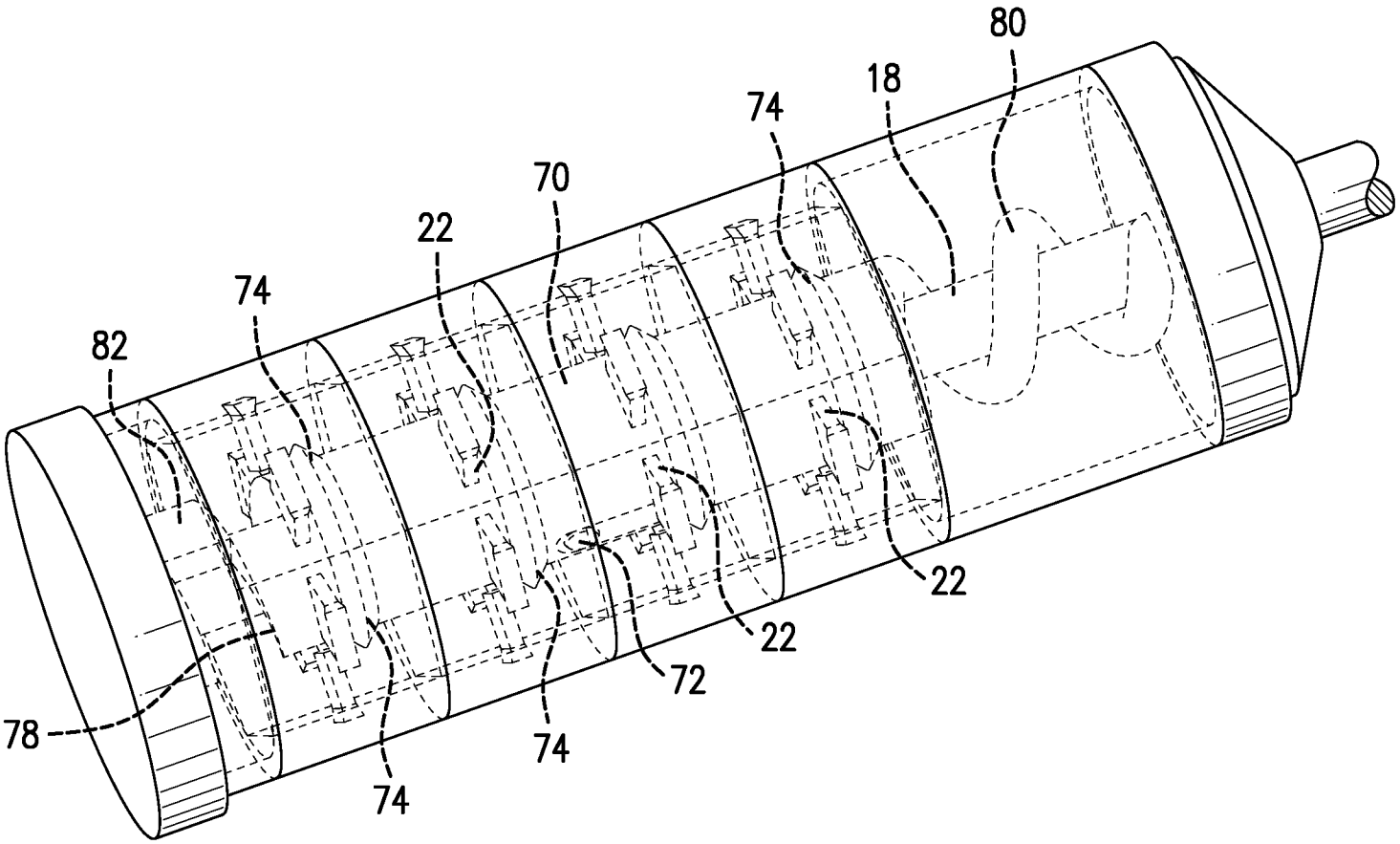
FIG. 19 is an enlarged perspective partially transparent view of the embodiment of FIGS. 16 and 17.
Figure 20:
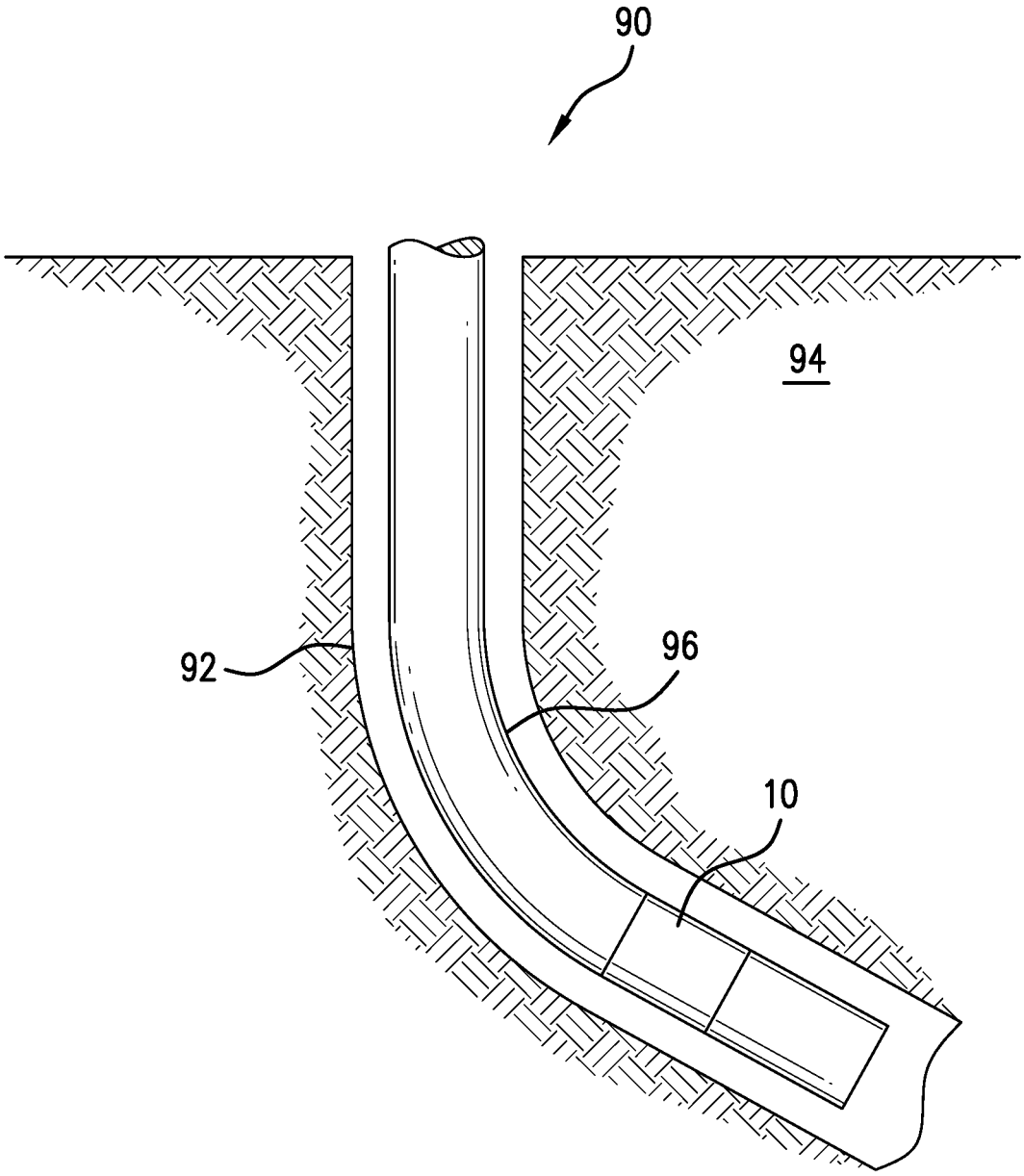
FIG. 20 is a view of a borehole system including the energy harvester as disclosed herein.

Referring to FIG. 19, a borehole system 90 is illustrated. The system 90 comprises a borehole 92 in a subsurface formation 94. A string 96 is disposed within the borehole 92. An energy harvester 10 as disclosed herein is disposed within or as a part of the string 96.

Set forth below are some embodiments of the foregoing disclosure:

Embodiment 1: An energy harvester, including a housing, an impeller supported in the housing, an agitator operably connected to the impeller, and a piezoelectric member supported by the housing, the member deflectable by the agitator due to rotation of the impeller.

Embodiment 2: The harvester as in any prior embodiment, wherein the impeller is a plurality of impellers.

Embodiment 3: The harvester as in any prior embodiment, wherein the plurality of impellers are disposed between one or more of a plurality of agitators.

Embodiment 4: The harvester as claimed in claim 1, wherein the agitator includes protrusions on an outside surface thereof.

Embodiment 5: The harvester as in any prior embodiment, wherein the agitator includes protrusions on an inside surface thereof.

Embodiment 6: The harvester as in any prior embodiment, wherein the agitator has spacing between adjacent teeth that causes one of 1) deflecting one member at a time, 2) deflecting a plurality of members at one time, or 3) deflecting all members at one time.

Embodiment 7: The harvester as in any prior embodiment, wherein when more than one member is deflected at one time, a phase of deflection is different.

Embodiment 8: The harvester as in any prior embodiment, wherein the agitator is a spoked ring.

Embodiment 9: The harvester as in any prior embodiment, wherein the agitator is a helical protrusion.

Embodiment 10: The harvester as in any prior embodiment, further comprising a shaft supported in the housing the shaft extending through the agitator.

Embodiment 11: The harvester as in any prior embodiment, wherein the agitator is a sleeve longitudinally movable on the shaft, the sleeve including at least one protrusion.

Embodiment 12: The harvester as in any prior embodiment, wherein the member is attached to the housing at a radially outward edge of the member, the member extending radially inwardly toward the agitator.

Embodiment 13: The harvester as in any prior embodiment, wherein the member is longitudinally aligned with the housing.

Embodiment 14: The harvester as in any prior embodiment, wherein the member is orthogonal to the housing.

Embodiment 15: The harvester as in any prior embodiment, wherein the member is longitudinally helical relative to the housing.

Embodiment 16: The harvester as in any prior embodiment, wherein the member is attached at an edge to a restraint positioned radially in the housing.

Embodiment 17: The harvester as in any prior embodiment, further including a flow straightener.

Embodiment 18: The harvester as in any prior embodiment, wherein the member acts as a flow straightener.

Embodiment 19: The harvester as in any prior embodiment, wherein a flow of fluid applied to the impeller contacts the member.

Embodiment 20: The harvester as in any prior embodiment, wherein a flow of fluid applied to the impeller is diverted prior to making contact with the member.

Embodiment 21: A method of generating power from a flowing fluid, including rotating an impeller with the flowing fluid, actuating an agitator with the impeller, and deflecting a piezoelectric member with the agitator.

Embodiment 22: The method as in any prior embodiment wherein the actuating is rotating.

Embodiment 23: The method as in any prior embodiment wherein the actuating is axially moving the agitator.

Embodiment 24: The method as in any prior embodiment wherein actuating includes biasing the agitator in a direction.

Embodiment 25: The method as in any prior embodiment wherein the agitator is shifted by a cycloidal barrel cam.

Embodiment 26: A borehole system, including a borehole in a subsurface formation, a string in the borehole, and an energy harvester as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An energy harvester, comprising:

a housing;

an impeller supported in the housing;

a helically configured agitator operably connected to the impeller; and a piezoelectric member supported by the housing, the member deflectable by the agitator due to rotation of the impeller.

2. The harvester as claimed in claim 1, wherein the impeller comprises a plurality of impellers.

3. The harvester as claimed in claim 2, wherein the plurality of impellers are disposed between one or more of a plurality of agitators.

4. The harvester as claimed in claim 1, wherein the agitator includes protrusions on an outside surface thereof.

5. The harvester as claimed in claim 1, wherein the agitator includes protrusions on an inside surface thereof.

6. The harvester as claimed in claim 4, wherein the agitator includes a plurality of teeth with spacing between adjacent teeth that causes one of 1) deflecting one piezoelectric member at a time, 2) deflecting a plurality of piezoelectric members at one time, or 3) deflecting all piezoelectric members at one time.

7. The harvester as claimed in claim 1, wherein the agitator further comprises a helical protrusion.

8. The harvester as claimed in claim 1, further comprising a shaft supported in the housing the shaft extending through the agitator.

9. The harvester as claimed in claim 8, wherein the agitator is a sleeve longitudinally movable on the shaft, the sleeve including at least one protrusion.

10. The harvester as claimed in claim 9, wherein the plurality of piezoelectric members are longitudinally helical relative to the housing.

11. The harvester as claimed in claim 1, wherein the plurality of piezoelectric members are attached to the housing at a radially outward edge of the plurality of piezoelectric members, and the plurality of piezoelectric members extend radially inwardly toward the agitator.

12. The harvester as claimed in claim 11, wherein the plurality of piezoelectric members are longitudinally aligned with the housing.

13. The harvester as claimed in claim 11, wherein the plurality of piezoelectric members are orthogonal to the housing.

14. The harvester as claimed in claim 1, wherein the plurality of piezoelectric members are attached at an edge to a restraint positioned radially in the housing.

15. The harvester as claimed in claim 1, further including a flow straightener.

16. The harvester as claimed in claim 1, wherein the plurality of piezoelectric members act as a flow straightener.

17. The harvester as claimed in claim 1, wherein a flow of fluid applied to the impeller contacts the plurality of piezoelectric members.

18. The harvester as claimed in claim 1, wherein a flow of fluid applied to the impeller is diverted prior to making contact with the plurality of piezoelectric members.

19. A borehole system, comprising:

a borehole in a subsurface formation;

a string in the borehole; and an energy harvester as claimed in claim 1 disposed within or as a part of the string.

20. A method of generating power from a flowing fluid, comprising:

rotating an impeller with the flowing fluid;

actuating an agitator by rotating a cycloidal barrel cam with the impeller; and deflecting a first piezoelectric member of a plurality of piezo electric members axially of the agitator.

21. The method as claimed in claim 20 wherein the actuating is axially moving the agitator.

22. The method of claim 21 wherein actuating includes biasing the agitator in a direction.

* * * * *